US007224351B2

(12) United States Patent
Lee

(10) Patent No.: US 7,224,351 B2
(45) Date of Patent: May 29, 2007

(54) LIQUID CRYSTAL DISPLAY AND DRIVING DEVICE THEREOF

(75) Inventor: Seung-Woo Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 461 days.

(21) Appl. No.: 10/287,916

(22) Filed: Nov. 5, 2002

(65) Prior Publication Data

US 2003/0085859 A1 May 8, 2003

(30) Foreign Application Priority Data

Nov. 5, 2001 (KR) ..... 10-2001-0068457
May 6, 2002 (KR) ..... 10-2002-0024781

(51) Int. Cl.
*G09G 5/00* (2006.01)

(52) U.S. Cl. ..... 345/205; 348/674; 345/88; 345/89

(58) Field of Classification Search ..... 345/87–104, 345/204, 205, 207, 209–215, 690; 348/674–677, 348/254–256
See application file for complete search history.

(56) References Cited

U.S. PATENT DOCUMENTS 5,764,216 A * 6/1998 Tanaka et al. ..... 345/87
5,990,979 A * 11/1999 Koyama et al. ..... 348/674
6,061,046 A * 5/2000 An ..... 345/98
6,154,121 A * 11/2000 Cairns et al. ..... 341/138
6,211,866 B1 * 4/2001 Okutani ..... 345/209
6,593,934 B1 * 7/2003 Liaw et al. ..... 345/590
6,781,532 B2 * 8/2004 Wei ..... 341/122
6,784,861 B2 * 8/2004 Okada ..... 345/87
6,879,310 B2 * 4/2005 Nose ..... 345/88
7,006,065 B1 2/2006 Sugawara et al.
2002/0070911 A1 * 6/2002 Koma ..... 345/88
2003/0043168 A1 * 3/2003 Dalal ..... 345/601
2004/0125422 A1 * 7/2004 Wang et al. ..... 358/519

FOREIGN PATENT DOCUMENTS

JP 05-080713 2/1993
JP 2001-134242 5/2001
JP 2004133402 A * 4/2004

* cited by examiner

*Primary Examiner*—Amr A. Awad
*Assistant Examiner*—Tom Sheng
(74) *Attorney, Agent, or Firm*—F. Chau & Associates, LLC

(57) ABSTRACT

The present invention discloses a data driver and a liquid crystal display including the same capable of solving the problems on the liquid crystal display and of decreasing the number of input pins of an external side by generating gamma reference voltages at internal or external side.

According to the present invention, a digital gamma storage is provided with digital gamma data for each of R, G and B through predetermined data bus from an external device on the basis of a predetermined gamma load signal, and a gamma reference voltage generator generates gamma reference voltages for gray display, which are used in converting display data into analog data, for each of R, G and B independently, on the basis of the stored digital gamma data for each of R, G and B. A digital-to-analog converter converts image data for each of R, G and B into analog voltages to output them on the basis of the generated gamma reference voltages.

As a result, it is possible to solve the problems on image quality of the liquid crystal display as well as to decrease the number of input pins of the external side by generating the gamma reference voltages for each of R, G and B without receiving them from an external device to control so that each of the R, G and B has an independent gamma curve.

16 Claims, 18 Drawing Sheets

500
R0
G0
B0
R1
G1
B1
Polarity Signal
600
700
DAC
200
210
DAC
221
222
223
251
252
253
S/H II
231
232
233
261
262
263
240
n
$D_{V9R}$ . . . $D_{V1R}$
$D_{V9G}$ . . . $D_{V1G}$
$D_{V9B}$ . . . $D_{V1B}$
$D_{V18R}$ . . . $D_{V10R}$
$D_{V18G}$ . . . $D_{V10G}$
$D_{V18B}$ . . . $D_{V10B}$

LIQUID CRYSTAL DISPLAY AND DRIVING DEVICE THEREOF

BACKGROUND OF THE INVENTION (a) Field of the Invention

The present invention relates to a liquid crystal display and a driving device thereof.

(b) Description of the Related Art

A typical liquid crystal display ("LCD") includes an upper panel provided with a common electrode and an array of color filters and a lower panel provided with a plurality of thin film transistors ("TFTs") and a plurality of pixel electrodes. The two panels have respective alignment films coated thereon and a liquid crystal layer is interposed therebetween. The pixel electrodes and the common electrode are applied with electric voltages and the voltage difference therebetween causes electric field. The variation of the electric field changes the orientations of liquid crystal molecules in the liquid crystal layer and in turn the transmittance of light passing through the liquid crystal layer, thereby obtaining desired images.

A typical data driver of an LCD includes a shift register, a data register, a data latch, a digital-to-analogue ("D/A") converter and an output buffer. The data driver latches red ("R"), green ("G") and blue ("B") data sequentially inputted in synchronization with a dot clock from a timing controller and alters the timing system from a dot-sequential scheme into a line-sequential scheme in to output data voltages to data lines of a liquid crystal panel assembly. The D/A converter converts the RGB data from the data latch into the respective analog voltages on the basis of gamma reference voltages VGMA1 to VGMA18 provided from an external device.

A normal LCD uses identical signals for R, G and B pixels assuming that their optical characteristics are the same, which are different in practice. As a result, there is a problem that the impression of colors for respective grays is not balanced or excessively biased.

To solve this problem, it is suggested to provide different sets of gamma reference voltages for respective R, G and B colors. However, this increases the number of pins of the data driver by thirty-six relative to the previous one and thus the size of the data driver. In addition, the unit for generating the gamma reference voltages has the increased number of blocks, i.e., three blocks for respectively generating corresponding sets of the gamma reference voltages for R, G and B colors. There is a problem that the increase of external circuits as well as the increase of the mounting area for the data driver in a printed circuit board ("PCB") raises the production cost of the LCD.

SUMMARY OF THE INVENTION

An object of the present invention is to improve image quality of an LCD by generating separate sets of gamma reference voltages for respective R, G and B colors.

To accomplish the object, an LCD according to a first aspect of the present invention includes a timing controller outputting digital gamma data for each of R, G and B and a data driver. The data driver includes a digital gamma storage, a gamma reference voltage generator and a digital-to-analog converter. The digital gamma storage stores digital gamma data from the timing controller, and the gamma reference voltage generator generates gamma reference voltages, which are used in converting image data into analog voltages, for each of R, G and B independently, on the basis of the stored digital gamma data. The digital-to-analog converter converts the image data for each of R, G and B into analog voltages to output them, on the basis of the generated gamma reference voltages.

Herein, the gamma reference voltage generator preferably includes a plurality of DACs receiving and converting digital gamma data for each of R, G and B into analog data.

An LCD according to a second aspect of the present invention includes a timing controller, a gamma reference voltage generator and a data driver. The timing controller outputs digital gamma data for each of R, G and B, and the gamma reference voltage generator converts the digital gamma data from the timing controller into analog data to output them. The data driver includes a sample/hold unit outputting sampled gamma reference voltages after performing sample/hold treatment of the gamma reference voltages from the gamma reference voltage generator, and a digital-to-analog converter converting image data for each of R, G and B into analog voltages to output them on the basis of the sampled gamma reference voltages.

BRIEF DESCRIPTION OF THE DRAWINGS

The above and other objects and advantages of the present invention will become more apparent by describing preferred embodiments thereof in detail with reference to the accompanying drawings in which.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout.

Now, LCDs and driving devices thereof according to embodiments of the present invention will be described in detail with reference to the accompanying drawings.

Figure 1:
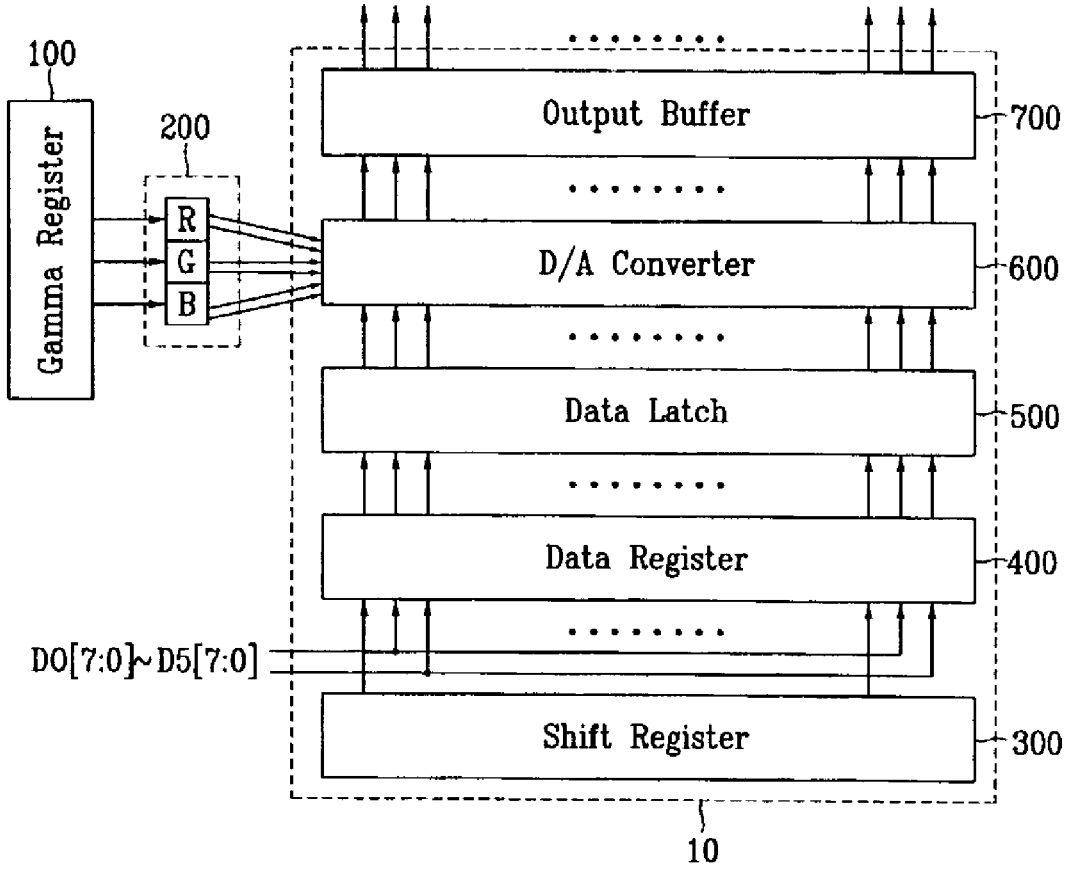
FIG. 1 is a schematic diagram of a data driver according to an embodiment of the present invention.
Figure 2:
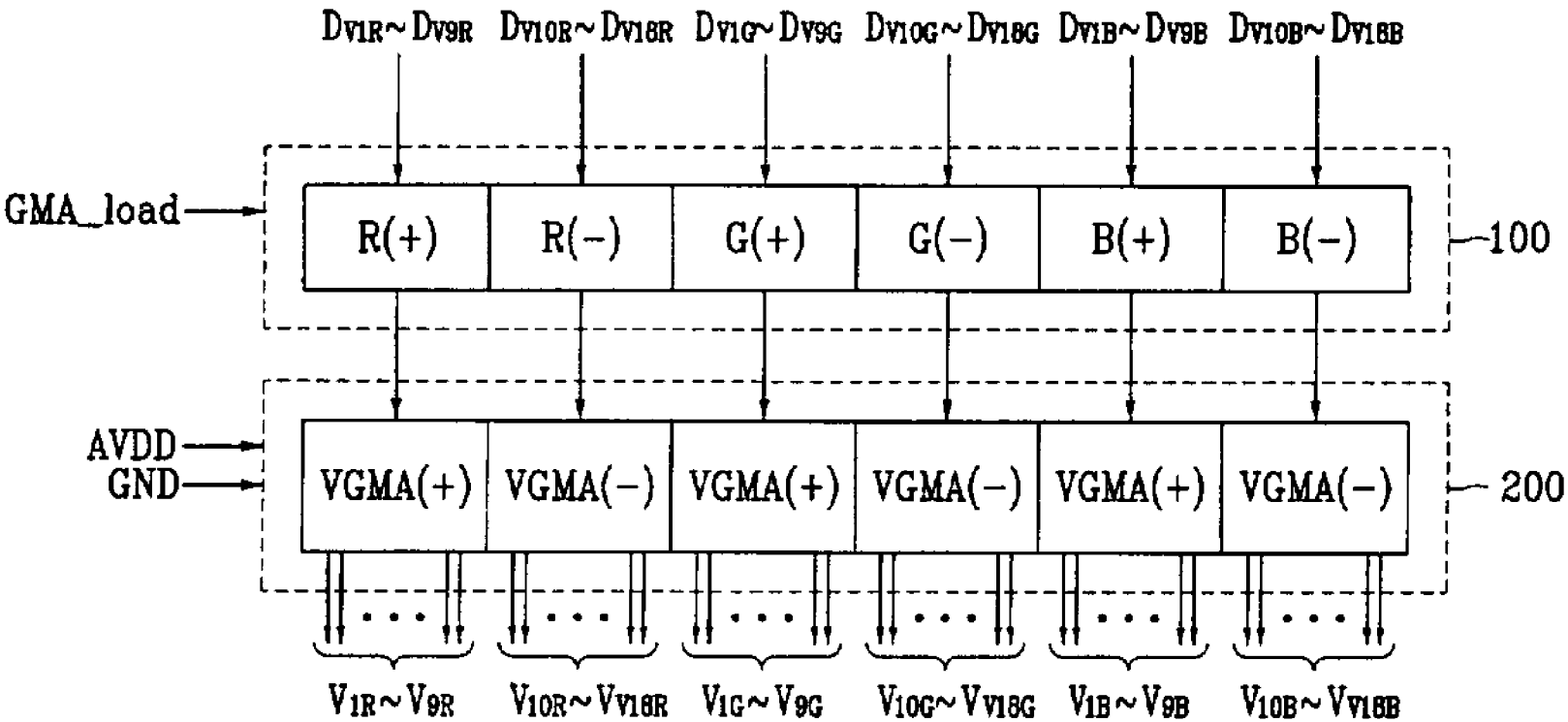
FIG. 2 is a diagram illustrating a gamma reference voltage generator shown in FIG. 1.

Referring to FIGS. 1 and 2, a data driver and a gamma reference voltage generator according to an embodiment of the present invention will be described in detail.

FIG. 1 is a schematic diagram of an exemplary data driver according to an embodiment of the present invention, and FIG. 2 illustrates a configuration of an exemplary gamma reference voltage generator shown in FIG. 1.

As shown in FIG. 1, the data driver 10 according to an embodiment of the present invention includes a gamma register 100, a gamma reference voltage generator 200, a shift register 300, a data register 400, a data latch 500, a D/A converter 600, and an output buffer 700. The shift register 300 shifts R, G and B data (D0[7:0]-D5[7:0]) from a timing controller (not shown) and stores the data in the data register 400. The D/A converter 600 receives the data stored in the data register 400 from the data latch 500 and converts the data into analogue gray voltages. The output buffer 700 stores the analogue gray voltages from the D/A converter 600 and applies the analogue gray voltages to a plurality of data lines upon receipt of a load signal. The gamma register 100 stores digital gamma data for respective R, G and B colors, and the gamma reference voltage generator 200 generates a plurality of sets of gamma reference voltages of respective R, G and B colors on the basis of the values stored in the gamma register 100 to provide for the D/A converter 600.

As shown in FIG. 2, the gamma register 100 receives the digital gamma data through a plurality of data buses from a timing controller (not shown) and stores the digital gamma data in response to the gamma load signal GMA_load. The gamma reference voltage generator 200 is connected to two external voltage sources AVDD and GND and converts the digital gamma data for each color and for each polarity into analog values to provide as positive/negative reference voltages for the D/A converter 600.

Gamma reference voltage generators according to embodiments of the present invention will be described in detail. In the embodiments of the present invention, the description will be made assuming that the number of the sets of the digital gamma data provided for the gamma reference voltage generator 200 is equal to 9×2×3, i.e., positive R, G and B digital gamma data $D_{V1R}$–$D_{V9R}$, $D_{V1G}$–$D_{V9G}$, $D_{V1B}$–$D_{V9B}$ and negative R, G and B digital gamma data $D_{V10R}$–$D_{V18R}$, $D_{V10G}$–$D_{V18G}$, $D_{V10B}$–$D_{V18B}$. However, the present invention is not limited to this but properly applied for any number of the sets of the digital gamma data.

First, a gamma reference voltage generator according to a first embodiment of the present invention will be described with reference to FIG. 3.

Figure 3:
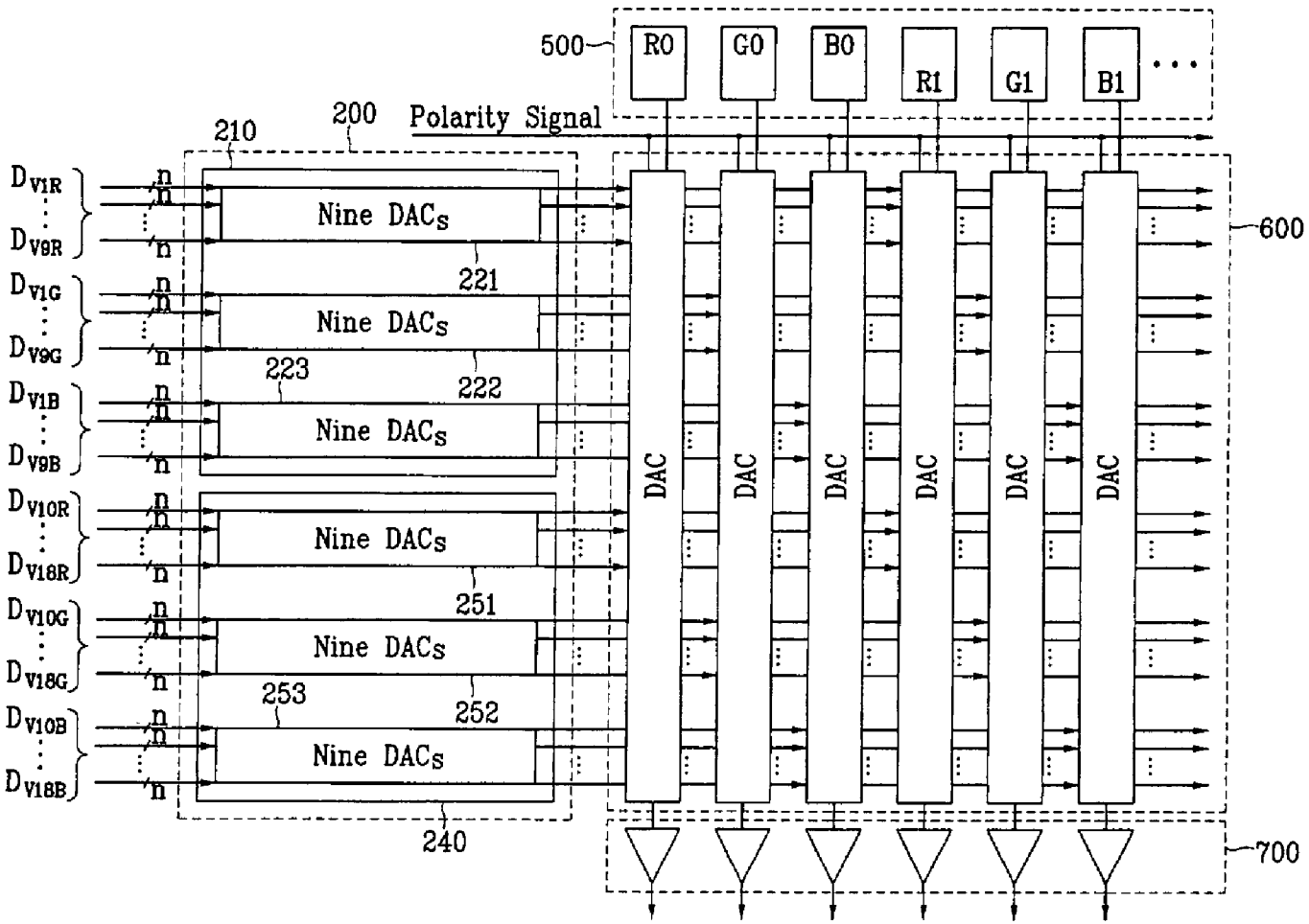
FIGS. 3 and 4 partially show exemplary data drivers according to first and second embodiments of the present invention, respectively.

FIG. 3 is a diagram illustrating an exemplary gamma reference voltage generator according to the first embodiment of the present invention.

As shown in FIG. 3, a gamma reference voltage generator 200 according to the first embodiment of the present invention includes a positive gamma reference voltage generator 210 and a negative gamma reference voltage generator 240 for positive and negative gamma voltages, respectively.

In this embodiment, the gamma reference voltage generator 200 receives digital gamma data for respective R, G and B colors from a gamma register 100 at the same time, and respective D/A converters ("DACs") 221–223 and 251–253 generate corresponding gamma reference voltages. In order for the gamma reference voltage generator 200 to generate all the R, G and B gamma reference voltages, the number of the DACs 221–223 and 251–253 provided in the gamma reference voltage generator 200 corresponds to the number of the R, G and B digital gamma data. For example, the gamma reference voltage generator 200 according to the first embodiment of the present invention preferably includes 9×2×3 DACs.

In detail, the positive gamma reference voltage generator 210 includes nine DACs 221–223 for each R, G and B color, each analogue-converting the corresponding positive R, G and B digital gamma data DV1R–DV9R, DV1G–DV9G and DV1B–DV9B to generate positive R, G and B gamma reference voltages V1R–V9R, V1G–V9G and V1B–V9B. Also, the negative gamma reference voltage generator 240 includes nine DACs 251–253 for each R, G and B color, each analogue-converting the corresponding positive R, G and B digital gamma data DV10R–DV18R, DV10G–DV18G and DV10B–DV18B into negative R, G and B gamma reference voltages V10R–V18R, V10G–V18G and V10B–V18B.

The D/A converter 600 converts the R, G and B image data R0, G0, B0, R1, G1, B1, . . . into analog voltages based on the positive and the negative gamma reference voltages V1R–V9R, V1R–V9R, V1B–V9B, V10R–V18R, V10G–V18G and V10B–V18B provided from the DACs 221–223 and 252–253.

Meanwhile, the number of the DACs in the gamma reference voltage generator 200 can be decreased relative to the first embodiment of the present invention, and, hereafter, such embodiments will be described with reference to FIGS. 4 to 12.

First, a gamma reference voltage generator according to a second embodiment of the present invention will be described with reference to FIGS. 4 and 5.

Figure 4:
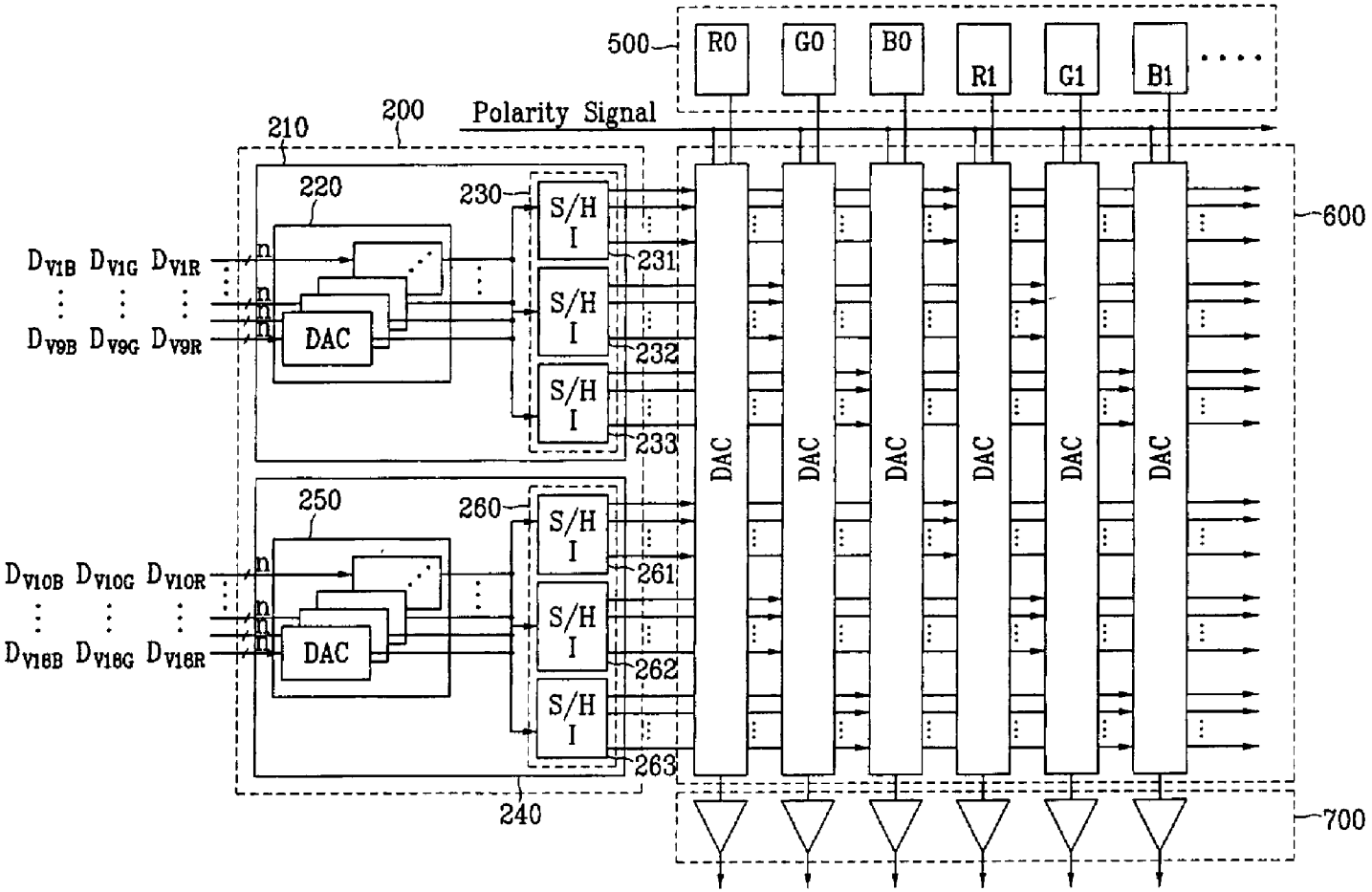
Figure 5:
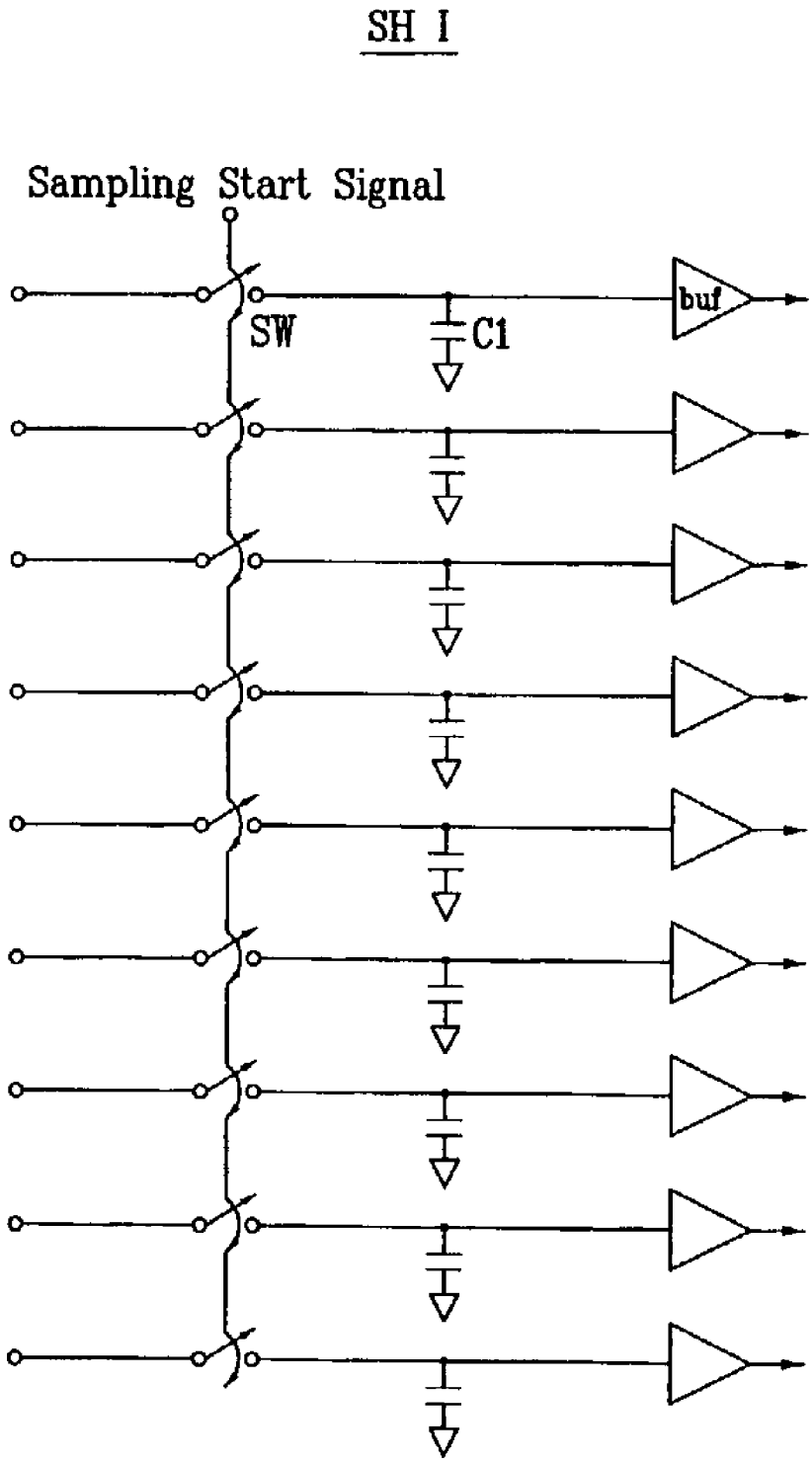
FIG. 5 is a diagram of an exemplary sample/hold circuit of the gamma reference voltage generator according to the second embodiment of the present invention.

FIG. 4 is a diagram illustrating an exemplary gamma reference voltage generator according to the second embodiment of the present invention, and FIG. 5 is a circuit diagram showing an exemplary sample/hold circuit included in the gamma reference voltage generator according to the second embodiment of the present invention.

As shown in FIG. 4, a gamma reference voltage generator 200 according to the second embodiment of the present invention also includes positive and negative gamma reference voltage generators 210 and 240, and each of the positive and the negative gamma reference voltage generators 210 and 240 includes a DAC unit 220 and 250 and a sample/hold unit 230 and 260.

The DAC unit 220 includes nine DACs analogue-converting the positive digital gamma data DV1R–DV9R, DV1G–DV9G and DV1B–DV9B inputted in time-divisional scheme for each R, G and B color to generate positive R, G and B gamma reference voltages V1R–V9R, V1G–V9G and V1B–V9B. The sample/hold unit 230 includes a plurality of sample/hold circuit units (S/H I) 231–233 for sampling the positive R, G and B gamma reference voltages V1R–V9R, V1G–V9G and V1B–V9B from the DAC unit 220. Likewise, the DAC unit 250 includes nine DACs analogue-converting negative digital gamma data DV10R–DV18R, DV10G–DV18G and DV10B–DV18B inputted in time-divisional scheme for each R, G and B color to generate negative R, G and B gamma reference voltages V10R–V18R, V10G–V18G and V10B–V18G. The sample/hold unit 260 includes a plurality of sample/hold circuit units (S/H I) 261–263 for sampling the negative gamma reference voltages V10R–V18R, V10G–V18G and V10B–V18G from the DAC unit 250.

In detail, the R sample/hold circuit unit 231 samples the positive R gamma reference voltages V1R–V9R to provide for the D/A converter 600. The D/A converter 600 converts R image data R0, R1, . . . the data latch 500 into analog voltages on the basis of the sampled positive R gamma reference voltages V1R–V9R. In the same way, the G and B sample/hold circuit units 262 and 263 respectively sample the positive G and B gamma reference voltages V1G–V9G and V1B–V9B to supply for the D/A converter 600. The DAC unit 250 and the sample/hold unit 260 in the negative gamma reference voltage generator 240 analogue-convert the negative R, G and B digital gamma data to generate the negative R, G and B gamma reference voltages V10R–V18R, V10G–V18G and V10B–V18G and sample to provide for the D/A converter 600.

One 231 of the sample/hold circuit units 231–233 and 261–263 of the sample/hold units 230 and 260 will be described in detail with reference to FIG. 5.

The sample/hold unit 231 includes nine sample/hold circuits for respectively sampling the positive R gamma reference voltages from the nine DACs of the DAC unit 220. Each sample/hold circuit includes a switch SW, a capacitor C1 and a buffer buf. When the switch SW is turned on in response to a sampling start signal, the gamma reference voltage from the DAC is stored in the capacitor C1 and sampled, and the sampled gamma reference voltage is provided for the D/A converter 600 through the analog buffer.

The number of the DACs provided in the gamma reference voltage generator 200 according to the second embodiment of the present invention is equal to 9+9=18, and is reduced to one thirds of that according to the first embodiment of the present invention as described above.

Although the second embodiment of the present invention employs separate DAC units for positive and negative polarities, the DAC capable of supporting both the positive and negative polarities may be used. Hereinafter, such an embodiment will be described with reference to FIG. 6.

Figure 6:
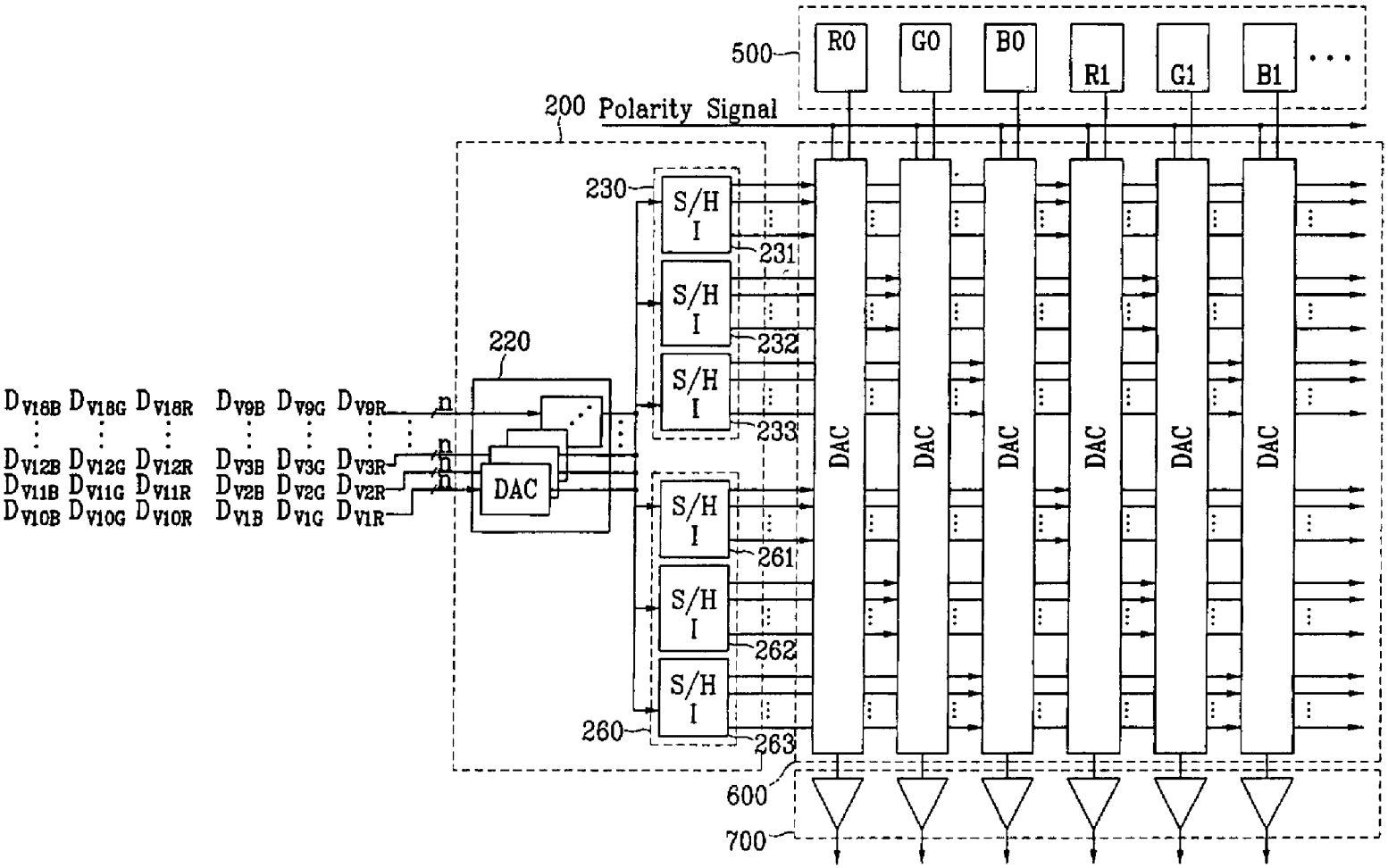
FIGS. 6 and 7 partially show exemplary data drivers according to third and fourth embodiments of the present invention, respectively.

FIG. 6 is a diagram of an exemplary gamma reference voltage generator according to a third embodiment of the present invention.

As shown in FIG. 6, a gamma reference voltage generator 200 according to the third embodiment of the present invention is almost the same as that of the second embodiment except using a single DAC unit 220 for the positive and negative digital gamma data.

In detail, the DAC unit 220 includes nine DACs, and analogue-converts positive R, G and B digital gamma data DV1R–DV9R, DV1G–DV9G and DV1B–DV9B and negative R, G and B digital gamma data DV10R–DV18R, DV10G–DV18G and DV10B–DV18B sequentially inputted in time-divisional scheme for respective R, G and B colors and polarities to generate the positive and the negative R, G and B gamma reference voltages V1R–V9R, V1G–V9G, V1B–V9B, V10R–V18R, V10G–V18G and V10B–V18B. In addition, the DAC unit 220 provides the positive and the negative R, G and B gamma reference voltages for two sample/hold units 230 and 260, respectively. The sample/hold units 230 and 260 are substantially the same as those described in the second embodiment of the present invention.

The number of the DACs provided in the gamma reference voltage generator 200 according to the third embodiment of the present invention is nine, which is decreased to one sixths of that according to the first embodiment of the present invention.

According to the second and the third embodiments of the present invention, since the timing controller (not shown) sequentially inputs the R, G and B digital gamma data in time-divisional scheme for respective R, G and B colors, the DACs provided in the DAC unit has a relation with the digital gamma data in one to one correspondence. However, eighteen digital gamma data for each R, G and B color can be inputted sequentially. Such an embodiment will now be described in detail with reference to drawings.

First, a gamma reference voltage generator according to a fourth embodiment of the present invention will be described with reference to FIGS. 7 and 8.

Figure 7:
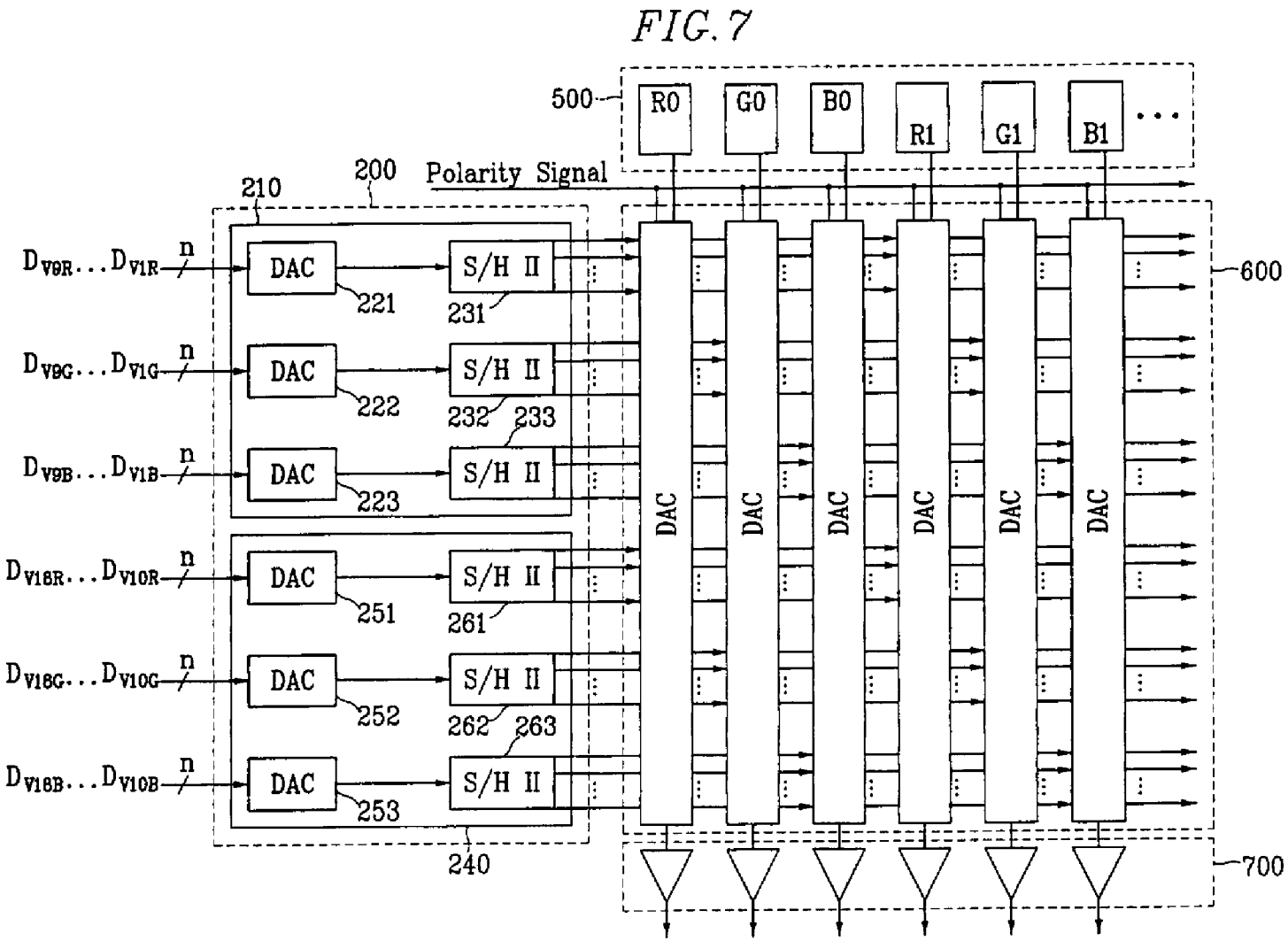
Figure 8:
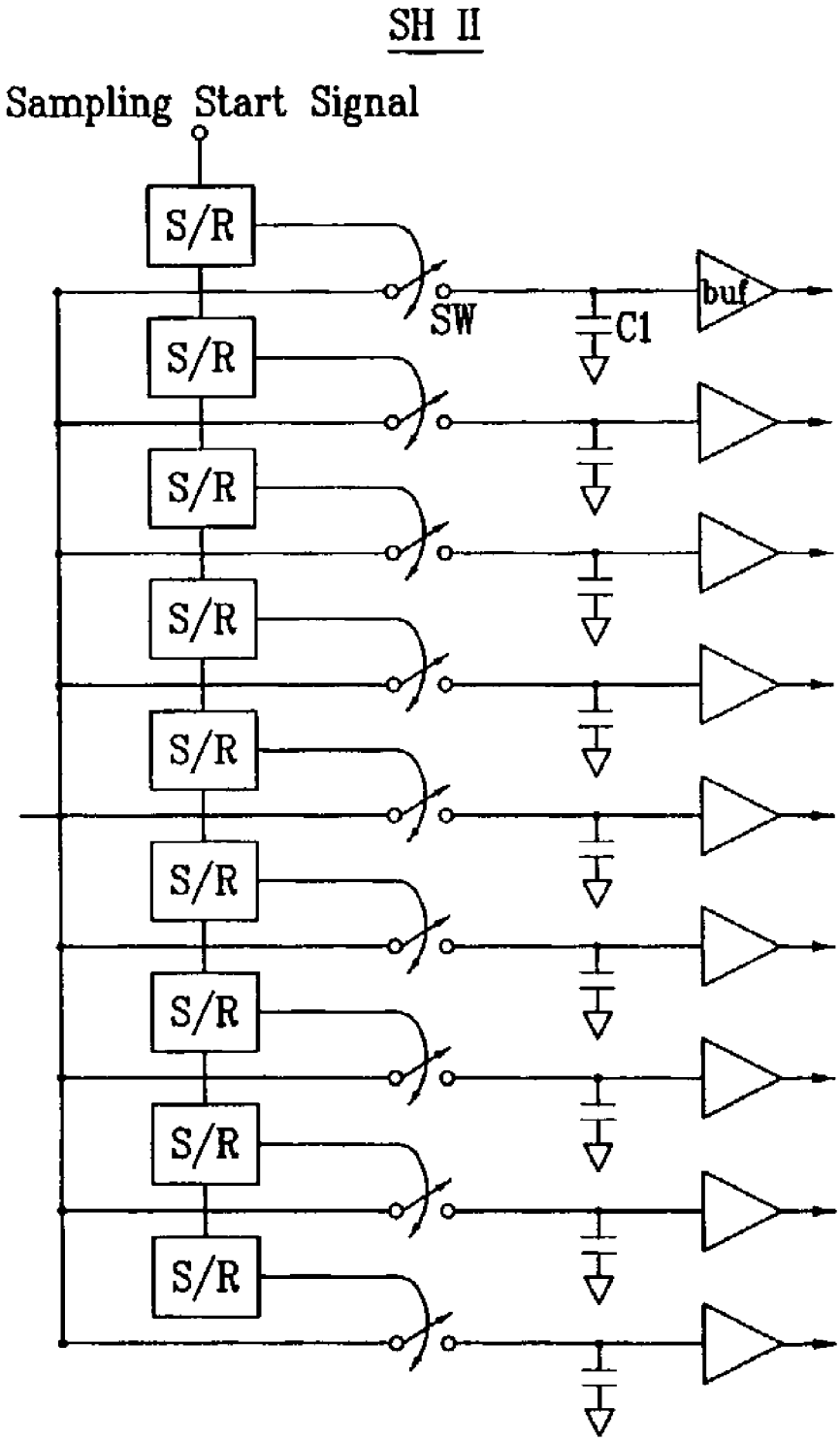
FIG. 8 is a diagram of an exemplary sample/hold circuit of the gamma reference voltage generator according to the fourth embodiment of the present invention.

FIG. 7 is a diagram of an exemplary gamma reference voltage generator according to the fourth embodiment of the present invention, and FIG. 8 illustrates an exemplary sample/hold circuit unit provided in the gamma reference voltage generator according to the fourth embodiment of the present invention.

As shown in FIG. 7, a gamma reference voltage generator 200 also includes positive and negative gamma reference voltage generators 210 and 240 like the first embodiment. The positive gamma reference voltage generator 210 includes three DACs 221–223 corresponding to respective positive R, G and B digital gamma data DV1R–DV9R, DV1G–DV9G and DV1B–DV9B and three sample/hold units 231–233 connected to the respective DACs 221–223. In the same way, the negative gamma reference voltage generator 240 includes three DACs 251–253 corresponding to respective R, G and B digital gamma data DV10R–DV18R, DV10G–DV18G and DV10B–DV18B and three sample/hold unit 261–263.

As shown in FIG. 7, the positive and the negative R, G and B digital gamma data DV1R–DV9R, DV1G–DV9G, DV1B–DV9B DV10R–DV18R, DV10G–DV18G and DV10B–DV18B from the timing controller are serially input for respective R, G and B colors and respective polarities to the DACs 221–223 and 252–253. The DACs 221–223 and 251–253 analogue-convert these digital gamma data and serially output the analog-converted positive and negative gamma reference voltages V1R–V9R, V1G–V9G, V1B–V9B, V10R–V18R, V10G–V18G and V10B–V18B to the respective sample/hold circuit units 231–233 and 261–263. The sample/hold circuit units 231–233 and 261–263 respectively sample the positive and the negative gamma reference voltages V1R–V9R, V1G–V9G, V1B–V9B, V10R–V18R, V10G–V18G and V10B–V18B to provide for the D/A converter 600.

Although each sample/hold circuit unit 231–233 and 261–263 according to the second and the third embodiments of the present invention described in FIG. 5 simultaneously sample and output the nine gamma reference voltages, the sample/hold circuit units 231–233 and 261–263 according to the fourth embodiment of the present invention sequentially sample and output the serially entered gamma reference voltages. For example, as shown in FIG. 8, one sample/hold circuit unit 231 includes nine sample/hold circuits connected to the output of the DAC 221. The sample/hold circuit includes a switch SW for switching the gamma reference voltage from the DAC 221, a capacitor C1 storing the gamma reference voltage inputted through the switch SW, an analog buffer buf outputting the gamma reference voltage stored in the capacitor C1 to the D/A converter 600, and a shift register S/R transmitting a sampling start signal for controlling turning on and off of the switch to a next sample/hold circuit.

The sample/hold circuit unit 231 sequentially outputs the gamma reference voltages from the DAC 221 in response to the shift of the sampling start signal through the shift register S/R.

Since the gamma reference voltage generator 200 employs according to the fourth embodiment of the present invention six DACs respectively for the positive and the negative R, G and B colors, the number of the DACs is decreased to one thirds of that according to the second embodiment.

Although a single DAC has been assigned to each R, G and B color with each polarity in the fourth embodiment of the present invention, the DAC may be irrelevant to the polarity. Such an embodiment will be described with reference to FIG. 9.

Figure 9:
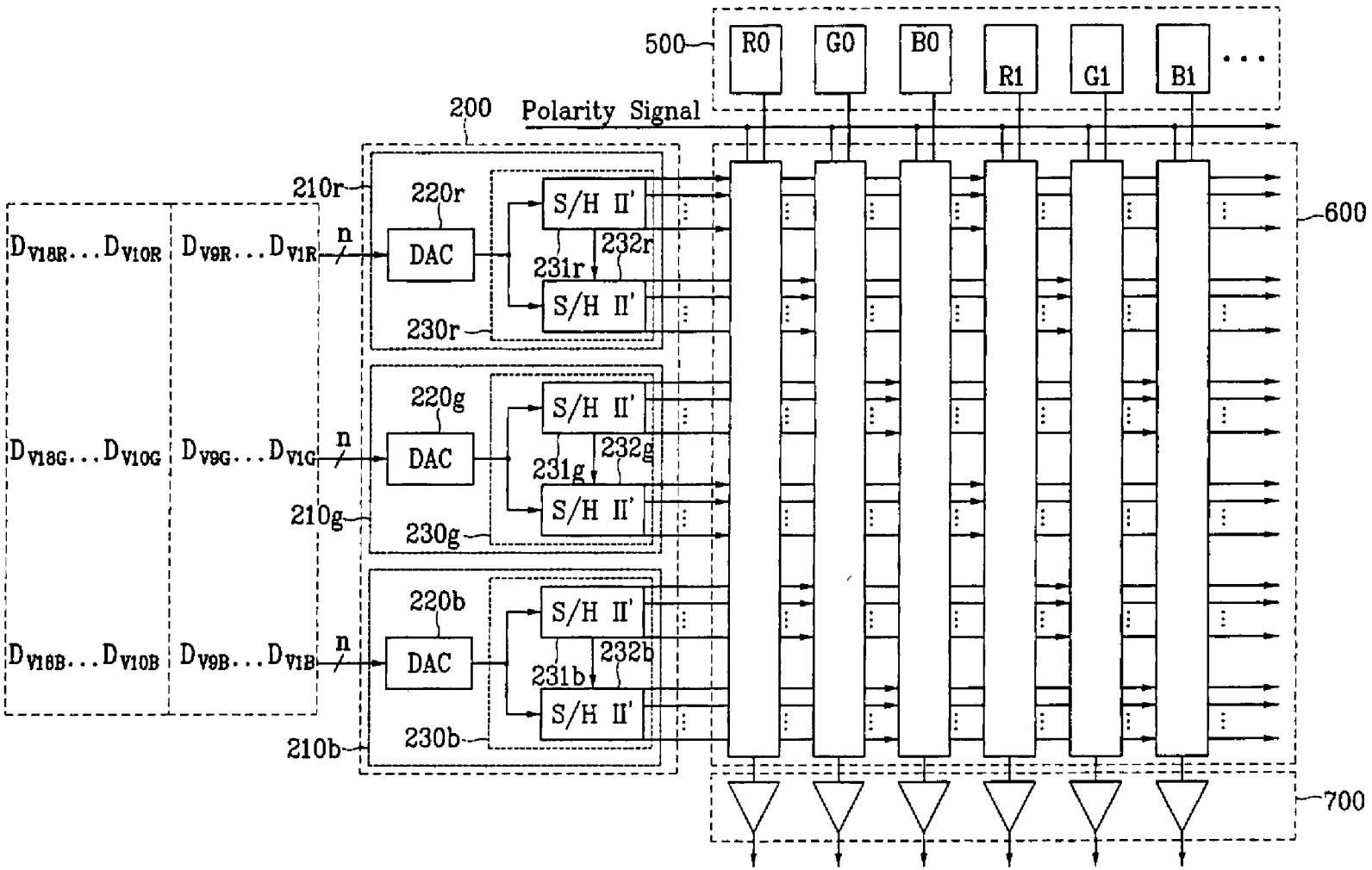
FIGS. 9 to 11 partially show exemplary data drivers according to fifth to seventh embodiments of the present invention.

FIG. 9 is a diagram illustrating an exemplary gamma reference voltage generator according to a fifth embodiment of the present invention.

As shown in FIG. 9, a gamma reference voltage generator 200 according to the fifth embodiment of the present invention includes R, G and B gamma reference voltage generators 210*r*, 210*g* and 210*b* for generating respective R, G and B gamma reference voltages. Each of the R, G and B gamma reference voltage generators 210*r*, 210*g* and 210*b* includes a DAC 220*r*, 220*g* and 220*b* and a sample/hold unit 230*r*, 230*g* and 230*b*, and each sample/hold unit 230*r*, 230*g* and 230*b* includes two sample/hold circuit units (S/H II') 231*r* and 232*r*, 231*g* and 232*g* and 231*b* and 232*b*. The DACs 220*r*, 220*g* and 220*b* analogue-convert the R, G and B digital gamma data DV1R–DV18R, DV1G–DV18G and DV1B–DV18B serially received from a timing controller, and outputs the analog-converted R, G and B gamma reference voltages V1R–V18R, V1G–V18G and V1B–V18B to the sample/hold units 230*r*, 230*g* and 230*b*, respectively. In the sample/hold units 230*r*, 230*g* and 230*b*, the sample/hold circuit units 231*r* and 232*r*, 231*g* and 232*g* and 231*b* and 232*b* are the same as those described in FIG. 8 excepting that the outputs of the last shift registers S/R of the sample/hold circuit unit 231*r*, 231*g* and 231*b* is used as the sampling start signal of the sample/hold circuit units 232*r*, 232*g* and 232*b*.

In detail, the sample/hold circuit unit 231*r* sequentially samples the positive R gamma reference voltages V1R–V9R of the R gamma reference voltages V1R–V18R outputted serially from the DAC 220*r* according to the sampling start signal, to output them to the D/A converter 600, and the sample/hold circuit unit 232*r* sequentially samples the negative R gamma reference voltages V10R–V18R according to the output of the last shift register S/R of the sample/hold circuit unit 231*r*, to output them to the D/A converter 600. In the same way, the sample/hold circuit units 231*g* and 231*b* sequentially sample the positive G and B gamma reference voltages V1G–V9G and V1B–V9B, respectively, according to the sampling start signal, and the sample/hold circuit units 232*g* and 232*b* sequentially sample the negative G and B gamma reference voltages V10G–V18G and V10B–V18B, respectively, according to the outputs of the last shift registers S/R of the sample/hold circuit units 231*g* and 231*b*.

According to the fifth embodiment of the present invention, the number of the DACs is decreased to a half of the fourth embodiment. Although the fifth embodiment has the DACs for each of R, G and B, the DACs may be used for each polarity. Such an embodiment will be described with reference to FIG. 10 in the following.

Figure 10:
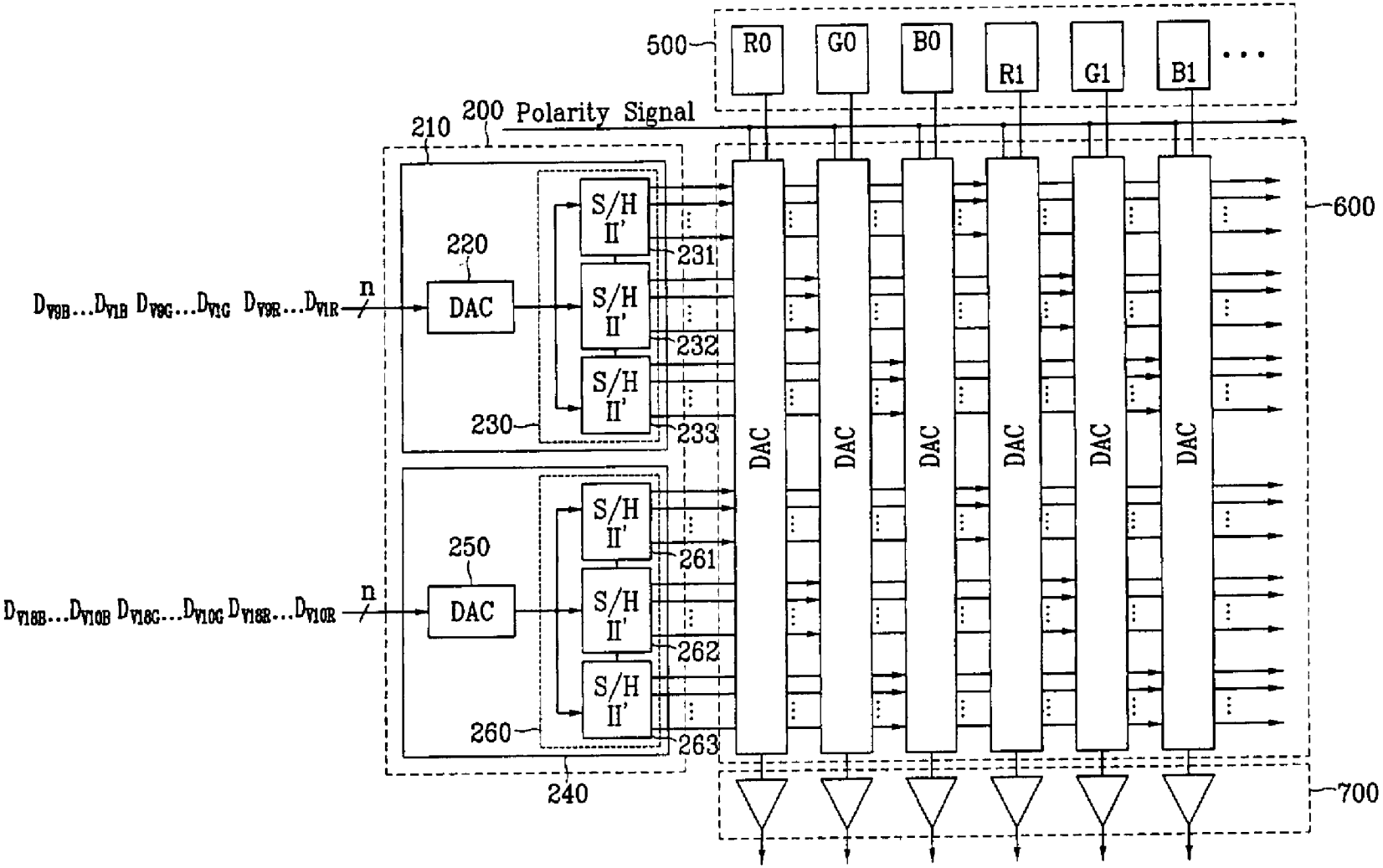

FIG. 10 illustrates an exemplary gamma reference voltage generator according to a sixth embodiment of the present invention.

As shown in FIG. 10, a gamma reference voltage generator according to the sixth embodiment of the present invention includes positive and negative gamma reference voltage generators 210 and 240 like the first embodiment of the present invention. The positive gamma reference voltage generator 210 includes one DAC 220 and sample/hold unit 230 including three sample/hold circuit units 231–233. The negative gamma reference voltage generator 240 includes one DAC 250 and sample/hold unit 260 including three sample/hold circuit units 262–263.

The DAC 220 serially receives the positive R, G and B digital gamma data DV1R–DV9R, DV1G–DV9G, DV1B–DV9B to convert them into the gamma reference voltages V1R–V9R, V1G–V9G, V1B–V9B, to output them to the sample/hold unit 230. In the same way, the DAC 250 serially receives the negative R, G and B digital gamma data DV10R–DV18R, DV10G–DV18G, DV10B–DV18B to convert them into the gamma reference voltages V10R–V18R, V10G–V18G, V10B–V18B to output them to the sample/hold unit 260.

The sample/hold circuit units 231–233 of the sample/hold unit 230 sample the positive R, G and B gamma reference voltages V1R–V9R, V1G–V9G, V1B–V9B, respectively, which are the same as the sample/hold circuit units described in FIG. 8, excepting that the outputs of the last shift registers S/R of the sample/hold circuit units 231 and 232 become the sampling start signal of the sample/hold circuit units 232 and 233, respectively, as described in the fifth embodiment. In the same way, the sample/hold circuit units 261–263 of the sample/hold unit 260 sample the negative R, G and B gamma reference voltages V10R–V18R, V10G–V18G, V10B–V18B, respectively.

By the gamma reference voltage generator according to the sixth embodiment of the present invention, just two DACs are used.

Meanwhile, in order to generate gamma reference voltages for each of R, G and B regardless of the polarities of the gamma reference voltages, only one DAC may be used. Such an embodiment will be described with reference to FIG. 11.

Figure 11:
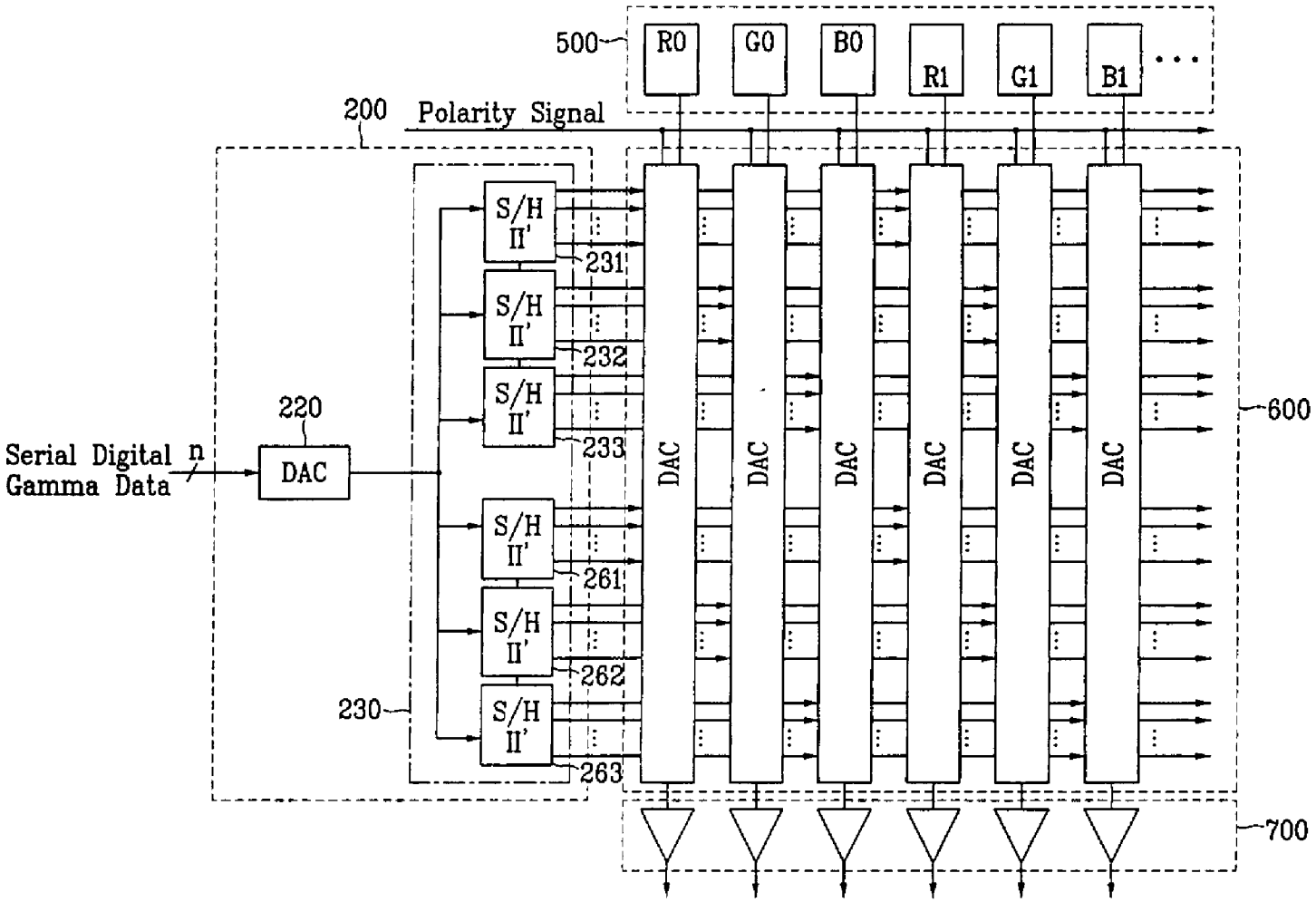

FIG. 11 is a diagram illustrating an exemplary gamma reference voltage generator according to a seventh embodiment of the present invention.

As shown in FIG. 11, a gamma reference voltage generator 200 according to the seventh embodiment of the present invention includes one DAC 220 and sample/hold unit 230, and the sample/hold unit 230 includes six sample/hold circuit units 231–233 and 262–263. The DAC 220 is serially provided with positive and negative R, G and B digital gamma data DV1R–DV9R, DV1G–DV9G, DV1B–DV9B DV10R–DV18R, DV10G–DV18G and DV10B–DV18B to convert them into positive and negative R, G and B gamma reference voltages V1R–V9R, V1G–V9G, V1B–V9B, V10R–V18R, V10G–V18G and V10B–V18B to output them to the sample/hold unit 230. The sample/hold circuit units 321–233 of the sample/hold unit 230 sample the positive R, G and B gamma reference voltages V1R–V9R, V1G–V9G, V1B–V9B, equally as described in the sixth embodiment, and the output of the last shift register of the sample/hold circuit unit 233 become the sampling start signal of the sample/hold circuit unit 261. Then, the sample/hold circuit units 261–263 sample the negative R, G and B gamma reference voltages V10R–V18R, V10G–V18G, V10B–V18B according to such sampling start signal.

According to the seventh embodiment of the present invention as above, only one DAC can be used in order to generate the gamma reference voltages.

Meanwhile, a time to take to generate the gamma reference voltages of the second and the third embodiments is three times and six times as long as that of the first embodiment, respectively, and a time of take to generate the gamma reference voltages of the fourth and the fifth embodiments is nine times and eighteen times as long as that of the first embodiment. A time to take to generate the gamma reference voltages is fifty four times as long as that of the first embodiment.

Figure 13:
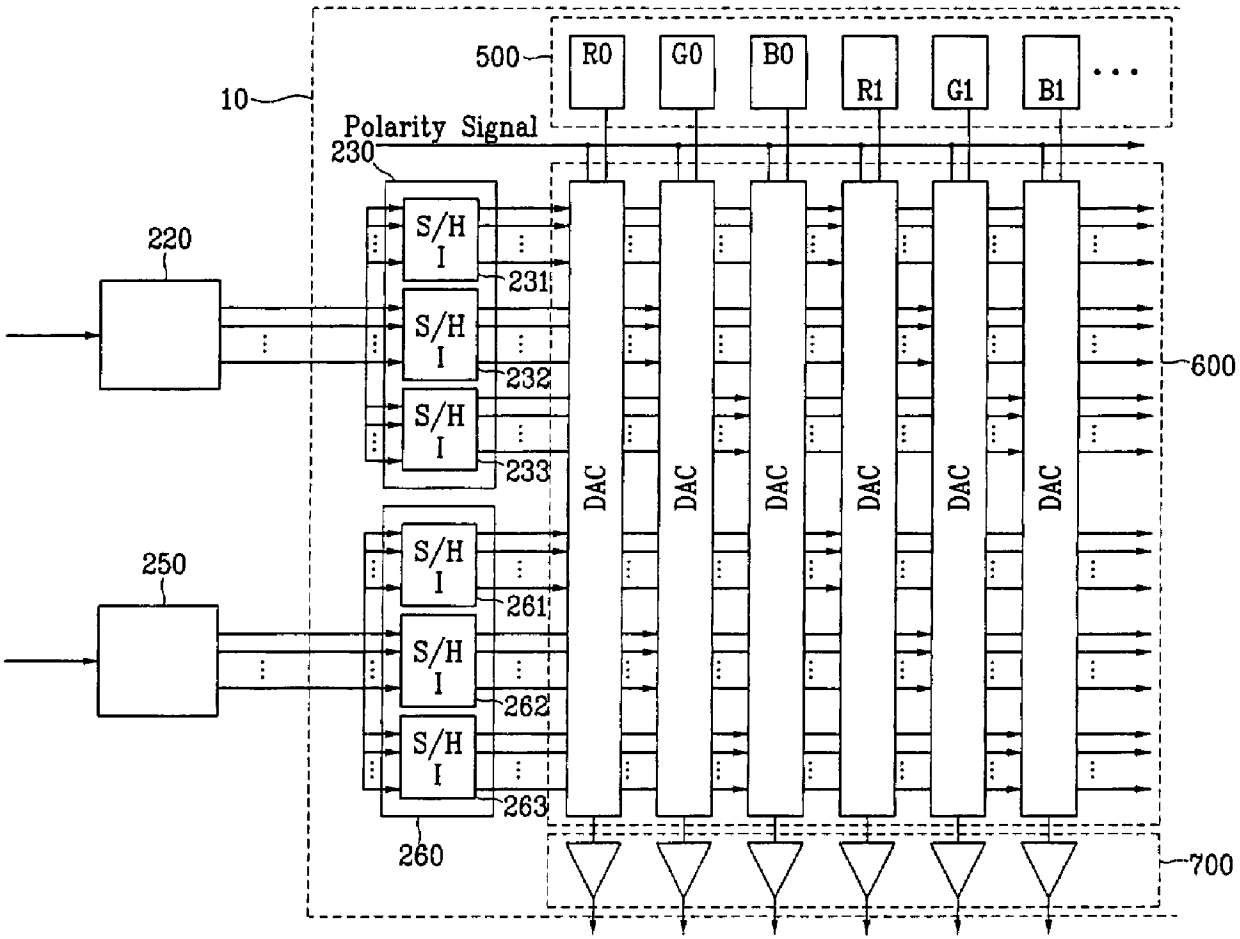
FIGS. 13 to 18 partially illustrate exemplary data drivers according to eight to thirteenth embodiments of the present invention.

Assuming that it takes one DAC 1 μs to generate gamma reference voltages, it takes the DAC of FIG. 5 1 μs, while it takes the DAC of FIG. 13 54 μs. Since such time is shorter than a blank interval with no data between frames, there is no problem in displaying a screen.

However, in case such time causes a problem, it is possible to decrease a time using a sample/hold circuit unit S/H III.

Figure 12:
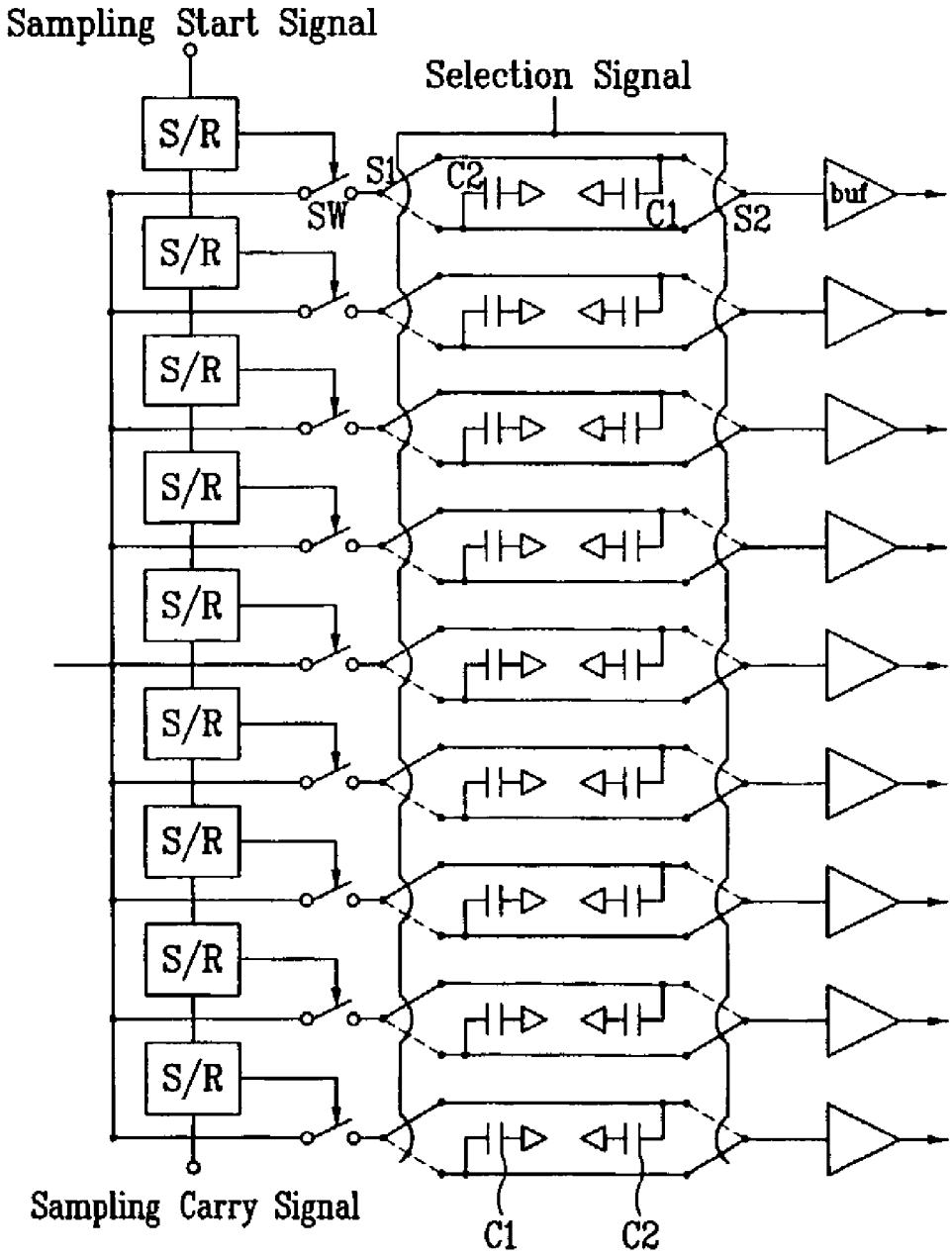
FIG. 12 is a diagram illustrating an exemplary sample/hold a gamma reference voltage generator according to an embodiment of the present invention.

FIG. 12 illustrates an exemplary sample/hold circuit S/H III according to another embodiment of the present invention.

As shown in FIG. 12, a sample/hold circuit unit S/H according to another embodiment of the present invention is composed of nine sample/hold circuits connected to output terminal of the DAC, and the sample/hold circuit includes a switch SW, a shift register S/R, capacitors C1 and C2, an analog buffer buf, input and output switches S1 and S2. The switch SW operates to transmit the gamma reference voltage from the DAC according to the sampling start signal, and the shift register S/R transmits the sampling start signal to next sample/hold circuit. The capacitors C1 and C2 are connected to first and second paths to charge the gamma reference voltage transmitted along the first and the second paths, and the analog buffer buf outputs the gamma reference voltage charged in the capacitors C1 and C2 to the D/A converter 600. In this case, the input switch S1 connected between the switch SW and the first and the second paths to alternate between the first and the second paths according to a selection signal, and the output switch S2 is connected between the first and the second paths and the analog buffer to alternate between the first and the second paths according to the selection signal.

In this sample/hold circuit unit S/H III, the gamma reference voltage inputted from one terminal is sequentially outputted according to transmittance of the sampling start signal through the shift register S/R.

An operation of the sample/hold circuit unit S/H III will be described.

When the present gamma voltage is stored in the capacitor C2, a changed gamma reference voltage is stored in the capacitor C1 to store all the changed gamma reference voltage in a capacitance corresponding to the capacitor C1, and thereafter, the gamma reference voltage of the capacitor C1 is outputted by altering the selection signal. Then, the gamma reference voltage is changed in so short a time. When this state is maintained and the gamma reference voltage is changed, new gamma reference voltage is stored in the capacitor C2, and after the storage of the new gamma reference voltage is completed, the gamma reference voltage charged in the capacitor C2 is only outputted.

This sample/hold circuit S/H III can be used instead of the sample/hold circuits S/H II and S/H II' in the embodiment described above and embodiments described below.

In the above, many embodiments for generating the gamma reference voltages at the internal side of the data driver 10 and decreasing an area occupied with the DACs for generating the gamma reference voltages have been described.

Meanwhile, the DACs for generating the gamma reference voltages may be implemented remote from the data driver 10, and such embodiments will be described in simplicity with reference to FIG. 13 to FIG. 18.

FIG. 13 is a diagram of an exemplary gamma reference voltage generator according to an eighth embodiment of the present invention.

Referring to FIG. 13, the eighth embodiment of the present invention is the same as the second embodiment excepting that positive and negative gamma reference voltage generators 220 and 250 for respectively receiving positive and negative digital gamma data DV1R–DV9R, DV1G–DV9G, DV1B–DV9B DV10R–DV18R, DV10G–DV18G, DV10B–DV18B to generate positive and negative gamma reference voltages V1R–V9R, V1G–V9G, V1B–V9B, V10R–V18R, V10G–V18G, V10B–V18B are provided at an external side of the data driver 10.

The positive and the negative gamma reference voltage generators 220 and 250 are composed of digital-to-analog converters of multiple channel system, respectively, and they output the positive and the negative R, G and B gamma reference voltages V1R–V9R, V1G–V9G, V1B–V9B, V10R–V18R, V10G–V18G, V10B–V18B time-divided for each of R, G and B. Sample/hold units 230 and 260, which respectively receive the positive and the negative R, G and B gamma reference voltages from the positive and the negative gamma reference voltage generators 220 and 250 to sample them, are provided within the data driver 10. The sample/hold units 230 and 260 are the same as that in the first embodiment.

Figure 14:
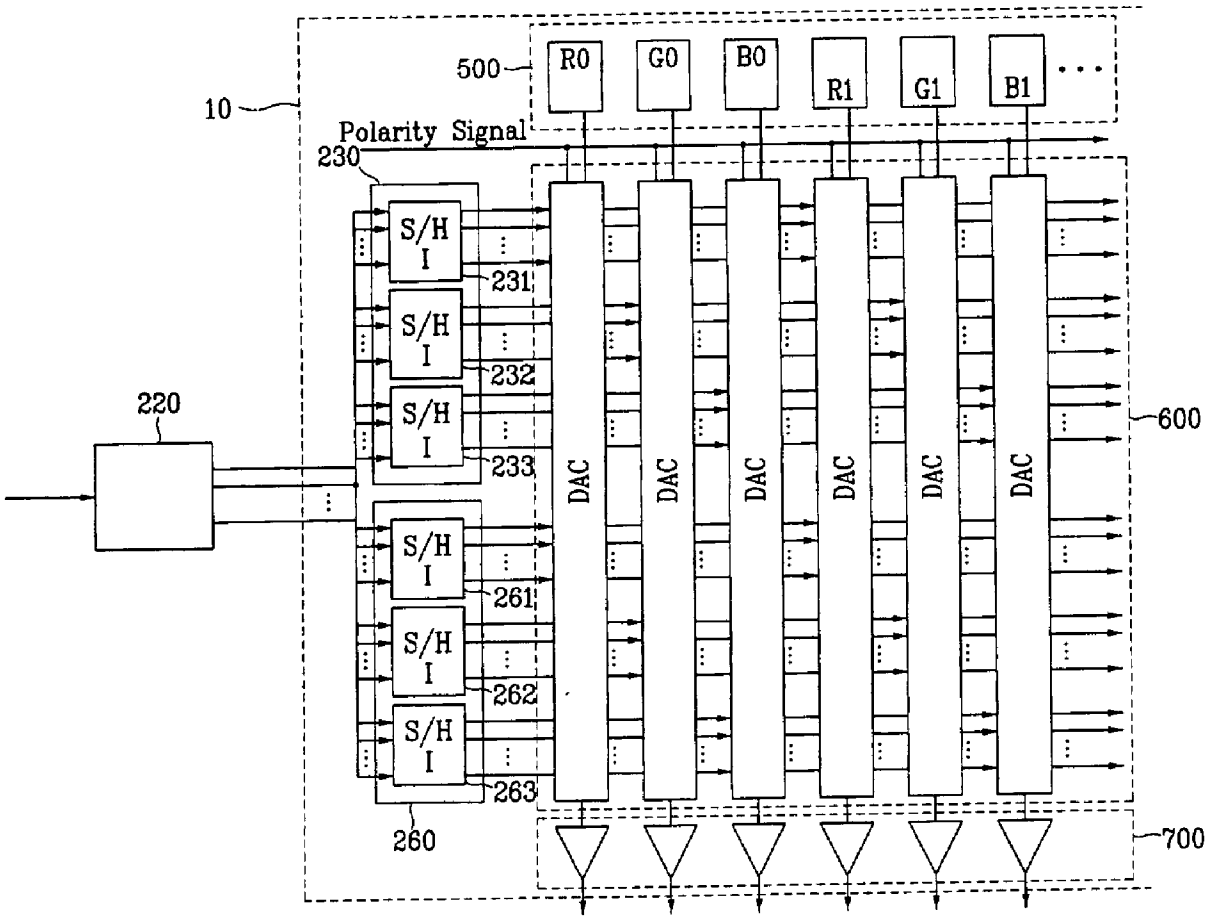

Although the eight embodiment of the present invention has the two digital-to-analog converters of multiple channel system that is divided for each polarity, it may have one digital-to-analog converter regardless of polarity as shown in FIG. 14.

FIG. 14 illustrates an exemplary gamma reference voltage generator according to a ninth embodiment of the present invention.

As shown in FIG. 14, the ninth embodiment is the same as the third embodiment excepting that a gamma reference voltage generator 220 for receiving digital gamma data DV1R–DV9R, DV1G–DV9G, DV1B–DV9B DV10R–DV18R, DV10G–DV18G, DV10B–DV18B from a timing controller to generate gamma reference voltages V1R–V9R, V1G–V9G, V1B–V9B, V10R–V18R, V10G–V18G, V10B–V18B is provided at an external side of a data driver 10.

The gamma reference voltage generator 220 is composed of digital-to-analog converters and outputs positive and negative R, G and B gamma reference voltages V1R–V9R, V1G–V9G, V1B–V9B, V10R–V18R, V10G–V18G, V10B–V18B time-divided for each of R, G and B to sample/hold circuit units 231–233 and 261–263. The sample/hold circuit units 231–233 and 261–263 for respectively receiving the positive and the negative R, G and B gamma reference voltages to sample them are provided within the data driver 10. The sample/hold circuit units 231–233 and 261–263 are the same as that of the second embodiment.

Figure 15:
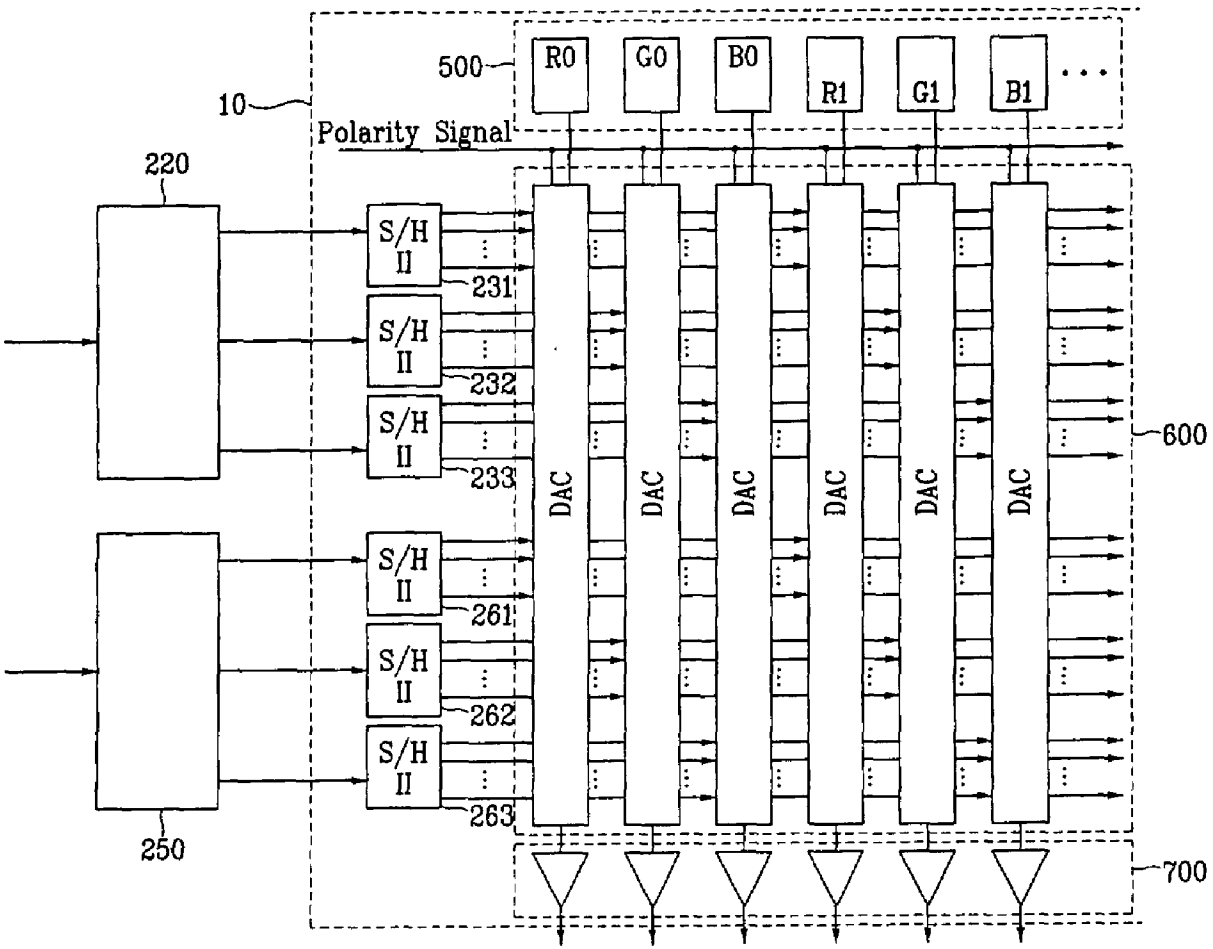

As shown in FIG. 15, a tenth embodiment of the present invention is the same as the fourth embodiment except positive and negative gamma reference voltage generators 220 and 250 respectively receiving positive and negative gamma reference voltages through a timing controller and a digital interface to generate positive and negative gamma reference voltages.

The positive and the negative gamma reference voltage generators 220 and 250 serializes the positive and the negative R, G and B gamma reference voltages for each of R, G and B to provide them to the sample/hold units 230 and 260 in the data driver 10. The sample/hold units 230 and 260 are the same as that of the fourth embodiment.

Figure 16:
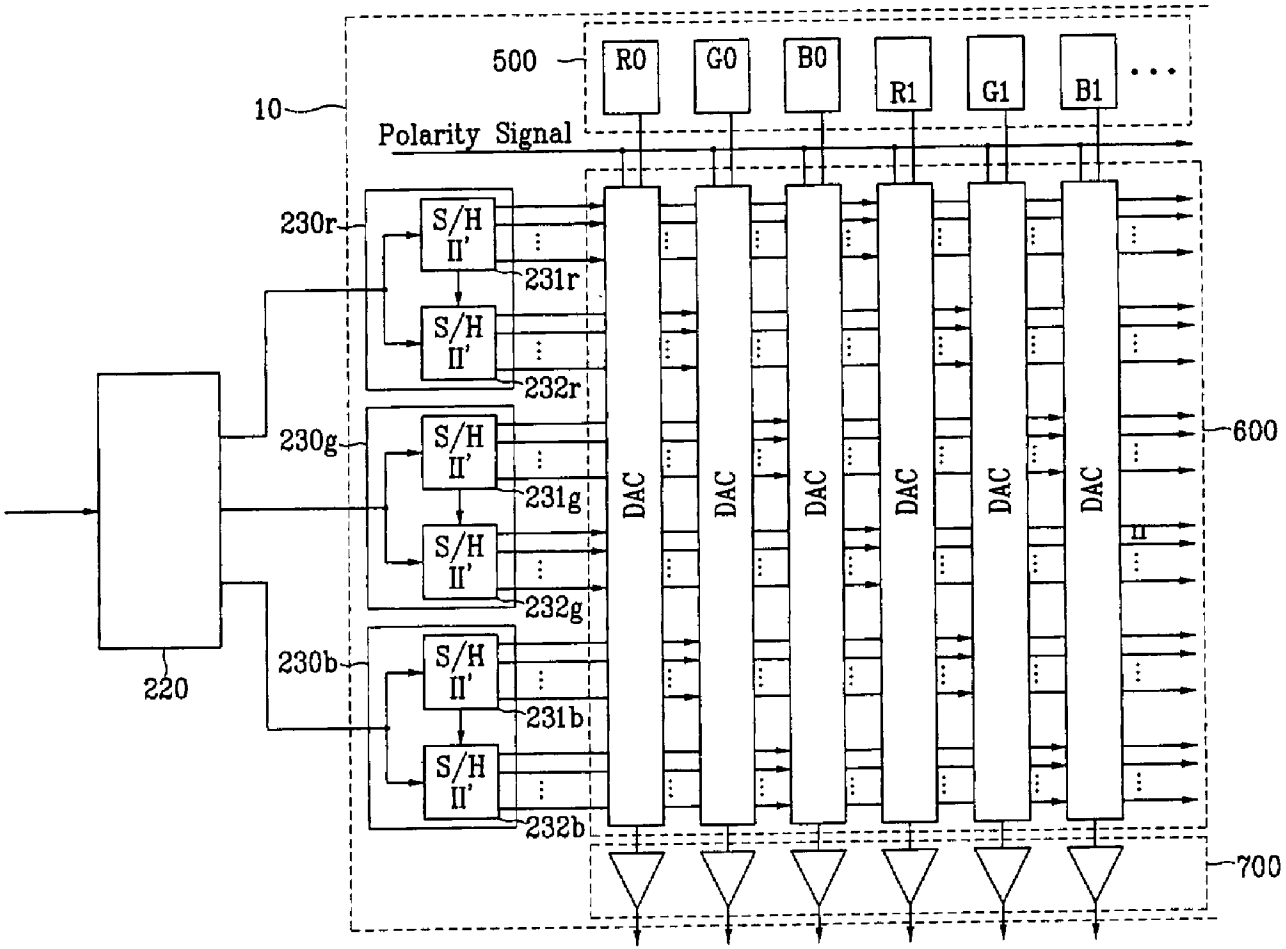

As shown in FIG. 16, an eleventh embodiment of the present invention is the same as the fifth embodiment except a gamma reference voltage generator 220 receiving digital gamma data through a timing controller and a digital interface to generate gamma reference voltages. The gamma reference voltage generator 220 serializes the gamma reference voltages for each of R, G and B to provide them to the sample/hold units 230*r*, 230*g* and 230*b* in the data driver 10. These sample/hold units 230*r*, 230*g* and 230*b* are the same as the sample/hold units 230*r*, 230*g* and 230*b* of the fifth embodiment.

Figure 17:
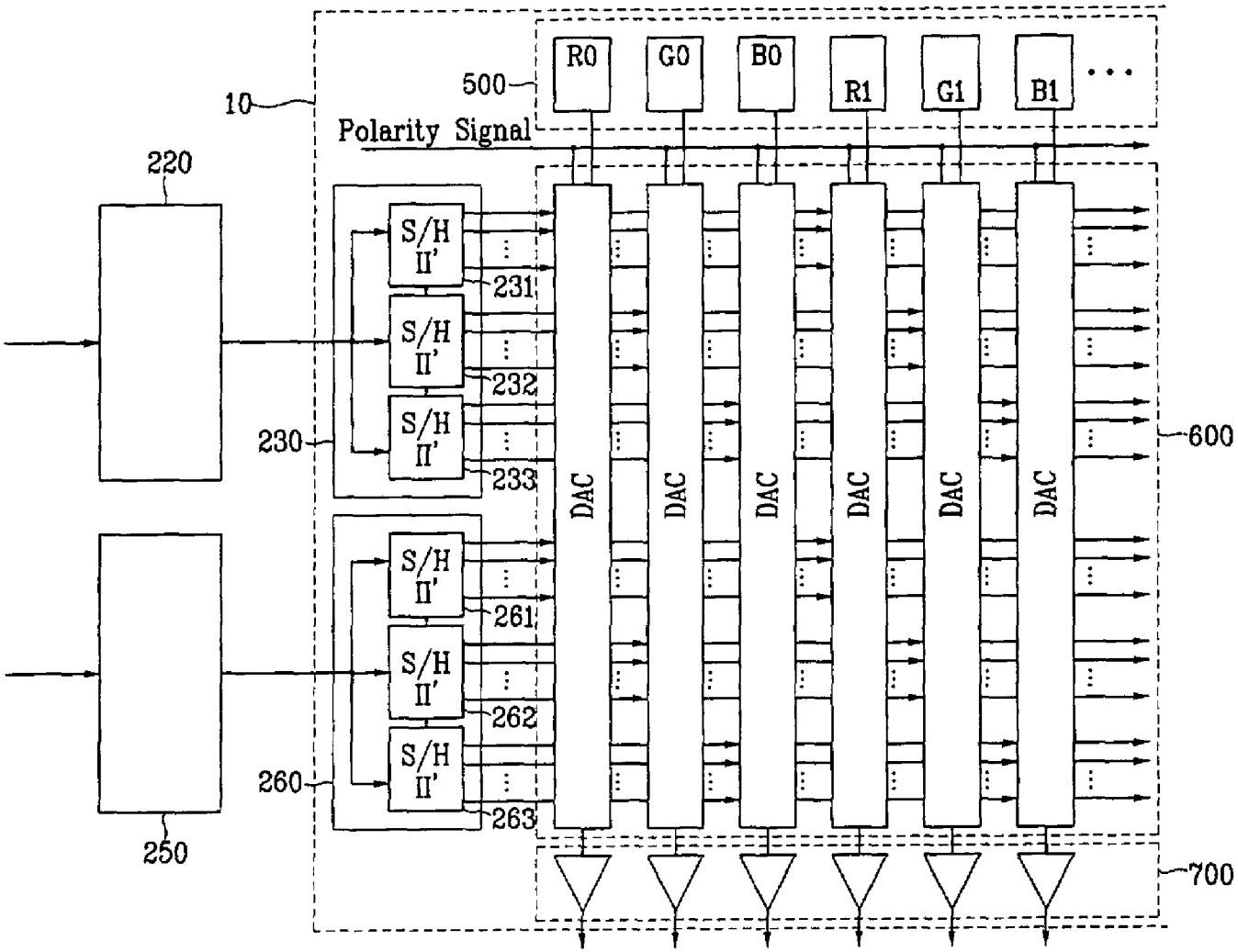

As shown in FIG. 17, a twelfth embodiment of the present invention is the same as the sixth embodiment except positive and negative gamma reference voltage generators 220 and 250 respectively receiving positive and negative gamma reference voltages through a timing controller and a digital interface to generate positive and negative gamma reference voltages. The positive and the negative gamma reference voltage generators 220 and 250 serializes the positive and the negative R, G and B gamma reference voltages for each of R, G and B to provide them to the sample/hold units 230 and 260 in the data driver 10. The sample/hold units 230 and 260 respectively include three sample/hold circuit units 231–233 and 261–263 like that of the sixth embodiment.

Figure 18:
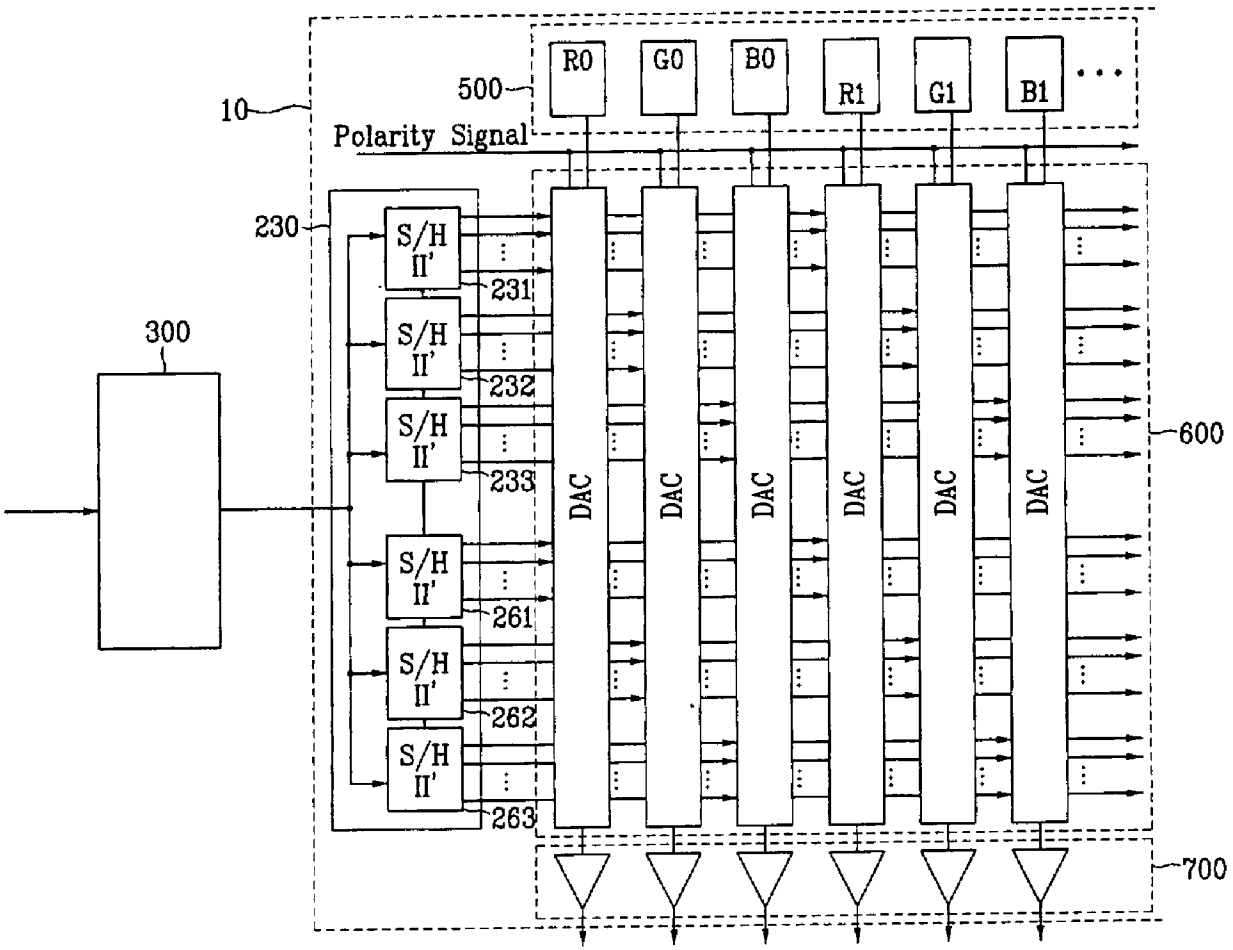

As shown in FIG. 18, a thirteenth embodiment of the present invention is the same as the seventh embodiment except a gamma reference voltage generator 220 receiving digital gamma data through a timing controller and a digital interface to generate gamma reference voltages. The gamma reference voltage generator 220 serializes the gamma reference voltages for each of R, G and B to provide them to the sample/hold unit 230 in the data driver 10. These sample/hold unit 230 includes six sample/hold units 231–233 and 261–263 like the seventh embodiment.

As described above, since the data driver can have the gamma reference voltage for each of R, G and B using the gamma reference voltage for each of R, G and B, it is possible to adjust temperature and coordinate of colors as desired.

In addition, it is possible to more variably implement a color tone that has been limited by the characteristics of the liquid crystal or the color filter.

Furthermore, it is possible to obtain a dynamic screen even in the moving pictures since new gamma is applicable to each of frames due to receiving digital gamma data from the timing controller. Of course, when the driving IC as above is applied, the timing controller is preferably also altered. That is, when the timing controller is supplied with power, it preferably transmits the gamma value for each of R, G and B to the data driver as digital type, and it preferably transmits the gamma values so that the gamma values can be adjusted by analyzing inputted data of screen when a dynamic screen desires to be watched.

What is claimed is:

1. A liquid crystal display comprising:

a timing controller outputting digital gamma data for respective R, G and B colors; and a data driver comprising a digital gamma storage storing the digital gamma data from the timing controller, a gamma reference voltage generator generating gamma reference voltages for respective R, G and B colors, which are used in converting image signals into analog voltages on the basis of the stored digital gamma data, and a digital-to-analog converter converting image data for each of R, G and B into analog voltages to output them on the basis of the generated gamma reference voltages, wherein the gamma reference voltage generator comprises:

a first polarity gamma reference voltage generator outputting sampled R, G and B gamma reference voltages with first polarities after performing sample/hold treatment of gamma reference voltage generated by sequentially receiving and converting serialized gamma data with first polarizes into analog data; and a second polarity gamma reference voltage generator outputting sampled R, G and B gamma reference voltages with second polarities after performing sample/hold treatment of gamma reference voltage generated by sequentially receiving and converting serialized gamma data with second polarities into analog data.

2. The liquid crystal display of claim 1, each of the first and the second gamma reference voltage generators comprises:

a DAC having a multi-to-one method and outputting gamma reference voltages, which are generated by sequentially receiving and converting the serialized digital gamma data into analog data, through one line; and a sample/hold unit sequentially performing sample/hold treatment of gamma reference voltages for each of R, G and B outputted from the DAC, wherein the sample/hold unit comprises three sample/hold circuits corresponding to each of R, G and B, and any one of the sample/hold circuit units starts sample/hold treatment by sampling start signal, and, after completion of the sample/hold treatment, the sampling start signal is transmitted to another sample/hold circuit unit.

3. A liquid crystal display as defined in claim 1, further comprising a driving device outputting data voltages for displaying images of the liquid crystal display, the driving device comprising:

a digital gamma storage storing digital gamma data from an external device;

a gamma reference voltage generator generating gamma reference voltages, which are used in converting image data into analog voltages, for each of R, G and B independently, on the basis of the stored digital gamma data; and a digital-to-analog converter converting image data of respective R , G and B into analog voltages to output them on the basis of the generated gamma reference voltages.

4. A liquid crystal display as defined in claim 1, further comprising a driving device outputting data voltages for displaying images of the liquid crystal display, the driving device comprising:

a sample/hold unit processing gamma reference voltages generated at an external device side to output sampled gamma reference voltages for respective R, G and B colors; and digital-to-analog converters converting image data of each of R, C and B into analog voltages to output them, on the basis of the sampled gamma reference voltages.

5. A liquid crystal display comprising:

a timing controller outputting digital gamma data for each of R, G and B;

a gamma reference voltage generator converting the digital gamma data from the timing controller into analog data to generate gamma reference voltages; and a data driver comprising a sample/hold unit outputting sampled gamma reference voltages for respective R, G and B colors after performing sample/hold treatment of the gamma reference voltage from the gamma reference voltage generator and a digital-to-analog converter converting image data for each of R, G and B into analog voltages on the basis of the sampled gamma reference voltages to output them, wherein the gamma reference voltage generator comprises a first polarity gamma reference voltage generator serializing first polarity R, G and B gamma reference voltages to output them, and a second polarity gamma reference voltage generator serializing second polarity R, G and B gamma reference voltages to output them, wherein the sample/hold unit comprises a first polarity sample/hold unit performing sample/hold treatment of the serialized first polarity R, G and B gamma reference voltages to output sampled R, G and B first polarity gamma reference voltages and a second polarity sample/hold unit performing sample/hold treatment of the serialized second polarity R, G and B gamma reference voltages to output sampled R, G and B second polarity gamma reference voltages, wherein each of the first and the second sample/hold units comprises three sample/hold circuit units corresponding to each of R, G and B, and any one of the sample/hold circuit units starts sample/hold treatment by sampling start signal and the sampling start signal is transmitted to another sample/hold circuit unit after completion of the sample/hold treatment in the any one of the sample/hold circuit units.

6. A liquid crystal display as defined in claim 5, each of the first and the second gamma reference voltage generators comprising:

a DAC having a multi-to-one method and outputting gamma reference voltages, which are generated by sequentially receiving and converting the serialized digital gamma data into analog data, through one line; and a sample/hold unit sequentially performing sample/hold treatment of gamma reference voltages for each of R, G and B outputted from the DAC, wherein the sample/hold unit comprises three sample/hold circuits corresponding to each of R, G and B, and any one of the sample/hold circuit units starts sample/hold treatment by sampling start signal, and, after completion of the sample/hold treatment, the sampling start signal is transmitted to another sample/hold circuit unit.

7. A liquid crystal display as defined in claim 5, further comprising a driving device outputting data voltages fair displaying images of the liquid crystal display, the driving device comprising:

a digital gamma storage storing digital gamma data from an external device;

a gamma reference voltage generator generating gamma reference voltages, which are used in converting image data into analog voltages, for each of R, G and B independently, on the basis of the stored digital gamma data; and a digital-to-analog converter converting image data of respective R, G and B into analog voltages to output them on the basis of the generated gamma reference voltages.

8. A liquid crystal display as defined in or claim 5, further comprising a driving device outputting data voltages for displaying images of the liquid crystal display, the driving device comprising:

a sample/hold unit processing gamma reference voltages generated at an external device side to output sampled gamma reference voltages for respective R, G and B colors; and digital-to-analog converters converting image data of each of R, G and B into analog voltages to output them, on the basis of the sampled gamma reference voltages.

9. A liquid crystal display comprising:

a timing controller outputting digital gamma data for respective R, G and B colors; and a data driver comprising a digital gamma storage storing the digital gamma data from the timing controller, a gamma reference voltage generator generating gamma reference voltages for respective R, G and B colors, which are used in converting image signals into analog voltages on the basis at the stored digital gamma data, and a digital-to-analog converter converting image data for each of R, G and B into analog voltages to output them on the basis of the generated gamma reference voltages, the gamma reference voltage generator outputting sampled R, C and B gamma reference voltages after performing sample/hold treatment a gamma reference voltages generated by sequentially receiving and converting serialized gamma data into analog data.

10. A liquid crystal display as defined in claim 9, the gamma reference voltage generator comprising:

a DAC having a multi-to-one method and outputting gamma reference voltages, which are generated by sequentially receiving and converting the serialized digital gamma data into analog data, through one line; and a sample/hold unit sequentially performing sample/hold treatment off gamma reference voltages for each of R, G and B outputted from the DAC, wherein the sample/hold unit comprises three sample/hold circuits corresponding to each of R, G and B, and any one of the sample/hold circuit units starts sample/hold treatment by sampling start signal, and, after completion of the sample/hold treatment, the sampling start signal is transmitted to another sample/hold circuit unit.

11. A liquid crystal display as defined in claim 9, further comprising a driving device outputting data voltages for displaying images of the liquid crystal display, the driving device comprising:

a digital gamma storage storing digital gamma data from an external device;

a gamma reference voltage generator generating gamma reference voltages, which are used in converting image data into analog voltages, for each of R, G and B independently, on the basis of the stored digital gamma data; and a digital-to-analog converter converting image data of respective R, G and B into analog voltages to output them on the basis of the generated gamma reference voltages.

12. A liquid crystal display as defined in claim 9, further comprising a driving device outputting data voltages for displaying images of the liquid crystal display, the driving device comprising:

a sample/hold unit processing gamma reference voltages generated at an external device side to output sampled gamma reference voltages for respective R, G and B colors; and digital-to-analog converters converting image data of each a R, G and B into analog voltages to output them, on the basis of the sampled gamma reference voltages.

13. A liquid crystal display comprising:

a timing controller outputting digital gamma data for respective R, G and B colors; and a data driver comprising a digital gamma storage storing the digital gamma data from the timing controller, a gamma reference voltage generator generating gamma reference voltages for respective R, G and B colors, which are used in converting image signals into analog voltages on the basis of the stored digital gamma data, and a digital-to-analog converter converting image data for each of R, G and B into analog voltages to output them on the basis of the generated gamma reference voltages, wherein the gamma reference voltage generator comprises a DAC having a multi-to-one method and outputting gamma reference voltages, which are generated by sequentially receiving and converting the digital gamma data into analog data, through one line.

14. A liquid crystal display as defined in claim 13, the gamma reference voltage generator comprising:

a DAC having a multi-to-one method and outputting gamma reference voltages, which are generated by sequentially receiving and converting the serialized digital gamma data into analog data, through one line; and a sample/hold unit sequentially performing sample/hold treatment of gamma reference voltages for each of R, G and B outputted from the DAC, wherein the sample/hold unit comprises three sample/hold circuits corresponding to each of R, G and B, and any one of the sample/hold circuit units starts sample/hold treatment by sampling start signal, and, after completion of the sample/hold treatment, the sampling start signal is transmitted to another sample/hold circuit unit.

15. A liquid crystal display as defined in claim 13, further comprising a driving device outputting data voltages for displaying images of the liquid crystal display, the driving device comprising:

a digital gamma storage storing digital gamma data from an external device;

a gamma reference voltage generator generating gamma reference voltages, which are used in converting image data into analog voltages, for each of R, G and B independently, on the basis of the stored digital gamma data; and a digital-to-analog converter converting image data of respective R, G and B into analog voltages to output them on the basis of the generated gamma reference voltages.

16. A liquid crystal display as defined in claim 13, further comprising a driving device outputting data voltages for displaying images of the liquid crystal display, the driving device comprising:

a sample/hold unit processing gamma reference voltages generated at an external device side to output sampled gamma reference voltages for respective R, G and B colors; and digital-to-analog converters converting image data of each of R, G and B into analog voltages to output them, on the basis of the sampled gamma reference voltages.

* * * * *